US010106354B2

(12) United States Patent
Karikusa et al.

(10) Patent No.: US 10,106,354 B2
(45) Date of Patent: Oct. 23, 2018

(54) SHEET CONVEYING DEVICE, IMAGE FORMING APPARATUS INCORPORATING THE SHEET CONVEYING DEVICE, AND POST PROCESSING DEVICE INCORPORATING THE SHEET CONVEYING DEVICE

(71) Applicants: Yuji Karikusa, Kanagawa (JP); Daiki Sekita, Kanagawa (JP)

(72) Inventors: Yuji Karikusa, Kanagawa (JP); Daiki Sekita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/906,494

(22) Filed: Feb. 27, 2018

(65) Prior Publication Data

US 2018/0251328 A1 Sep. 6, 2018

(30) Foreign Application Priority Data

Mar. 2, 2017 (JP) ..... 2017-039291
Feb. 1, 2018 (JP) ..... 2018-016423

(51) Int. Cl.

| | |
|---|---|
| ***B65H 7/02*** | (2006.01) |
| ***B65H 9/00*** | (2006.01) |
| ***G03G 15/00*** | (2006.01) |
| ***B41J 11/00*** | (2006.01) |
| ***B41J 13/02*** | (2006.01) |
| ***B65H 9/20*** | (2006.01) |
| ***B65H 5/06*** | (2006.01) |
| ***B41J 13/00*** | (2006.01) |
| ***B65H 7/14*** | (2006.01) |

(52) U.S. Cl.

CPC ..... *B65H 9/002* (2013.01); *B41J 11/0095* (2013.01); *B41J 13/0036* (2013.01);

(Continued)

(58) Field of Classification Search

CPC ... B65H 7/00; B65H 7/02; B65H 7/08; B65H 7/10; B65H 7/14; B65H 7/20;

(Continued)

(56) References Cited

U.S. PATENT DOCUMENTS

2013/0175312 A1* 7/2013 Nakano ..... A61F 13/15772 226/15
2013/0300055 A1* 11/2013 Ishikawa ..... B65H 9/00 271/227

(Continued)

FOREIGN PATENT DOCUMENTS

JP 6-234441 8/1994
JP 9-175694 7/1997

(Continued)

*Primary Examiner* — Prasad V Gokhale
(74) *Attorney, Agent, or Firm* — Harness, Dickey & Pierce, P.L.C.

(57) ABSTRACT

A sheet conveying device, which is included in an image forming apparatus and a post processing device, includes a position detector configured to detect a position of a sheet, a sheet conveying body, a fixed body, a movable body configured to move, relative to the fixing body, between a first position and a second position different from the first position, and an index mounted on the fixed body. The sheet conveying device further includes a data storing device, a conveyance positional deviation calculator configured to calculate a positional deviation amount of the sheet to the reference sheet conveyance position, a detected positional deviation calculator configured to calculate a positional deviation amount of the position detector to the index based on a result of the position detector, and a reference position detector configured to correct the reference sheet conveyance position based on a result of the detected positional deviation calculator.

16 Claims, 18 Drawing Sheets

(52) U.S. Cl.
CPC ..... *B41J 13/02* (2013.01); *B65H 5/062* (2013.01); *B65H 7/14* (2013.01); *B65H 9/20* (2013.01); *G03G 15/6529* (2013.01); *G03G 15/70* (2013.01); *B65H 2553/81* (2013.01); *G03G 2215/00548* (2013.01); *G03G 2215/00616* (2013.01)

(58) Field of Classification Search
CPC ..... B65H 9/103; B65H 9/12; B65H 9/002; B65H 9/20; B65H 2402/45; B65H 2553/81; B65H 2557/61; B65H 2601/10–2601/12
See application file for complete search history.

(56) References Cited

U.S. PATENT DOCUMENTS

| | | | | |
|---|---|---|---|---|
| 2015/0183605 | A1* | 7/2015 | Kato | B65H 9/20 271/227 |
| 2016/0159598 | A1 | 6/2016 | Yamane et al. | |
| 2018/0162667 | A1* | 6/2018 | Matsuda | B65H 9/002 |

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2007-193193 | 8/2007 |
| JP | 2010-052923 | 3/2010 |
| JP | 2010-089868 | 4/2010 |
| JP | 2011-098790 | 5/2011 |
| JP | 2014-088263 | 5/2014 |
| JP | 2014-193769 | 10/2014 |
| JP | 2016-024546 | 2/2016 |
| JP | 2016-044067 | 4/2016 |
| JP | 2016-108152 | 6/2016 |
| JP | 2016-175776 | 10/2016 |
| JP | 2016-188142 | 11/2016 |

* cited by examiner

SHEET CONVEYING DEVICE, IMAGE FORMING APPARATUS INCORPORATING THE SHEET CONVEYING DEVICE, AND POST PROCESSING DEVICE INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-039291, filed on Mar. 2, 2017, and 2018-016423, filed on Feb. 1, 2018, in the Japan Patent Office, the entire disclosure of each of which is hereby incorporated by reference herein.

BACKGROUND

Technical Field

This disclosure relates to a sheet conveying device that conveys a sheet, an image forming apparatus including the sheet conveying device, and a post processing device including the sheet conveying device.

Related Art

Various kinds of image forming apparatuses such as copiers and printers employ a technique, for example, to detect an angular displacement amount and a lateral displacement amount of the sheet in conveyance of a sheet such as a paper material and an OHP (overhead projector) film sheet and to correct the position of the sheet to a correct position.

Known sheet conveying devices that perform correction of a sheet position includes a sheet conveying device that corrects the position of a sheet with photosensors, contact image sensors (CIS) or both.

SUMMARY

At least one aspect of this disclosure provides a sheet conveying device including a position detector, a sheet conveying body, a fixed body, a movable body, and an index. The position detector is configured to detect a position of a sheet. The sheet conveying body is configured to convey the sheet. The movable body is a body on which the position detector is mounted and is configured to move, relative to the fixing body, between a first position at which the position detector detects the position of the sheet and a second position different from the first position. The index is mounted on the fixed body and is configured to function as a reference position based on which a positional deviation amount of the position detector at the first position is calculated.

Further, at least one aspect of this disclosure provides an image forming apparatus including the above-described sheet conveying device.

Further, at least one aspect of this disclosure provides a post processing device including a sheet receiving device configured to receive a sheet conveyed from an image forming apparatus and the above-described sheet conveying device.

Further, at least one aspect of this disclosure provides a sheet conveying device including a position detector, a data storing device, a conveyance positional deviation calculator, a sheet conveying body, a fixed body, a movable body, an index, a detected positional deviation calculator, and a reference position corrector. The position detector is configured to detect a position of a sheet. The data storing device is configured to function as a reference position to detect a positional deviation amount of the sheet and store a reference sheet conveyance position determined according to a relative positional relation to the position detector. The conveyance positional deviation calculator is configured to calculate a positional deviation amount of the sheet relative to the reference sheet conveyance position, based on a detection result of the position of the sheet by the position detector. The sheet conveying body is configured to convey the sheet. The movable body is a body on which the position detector is mounted and is configured to move, relative to the fixing body, between a first position at which the position detector detects the position of the sheet and a second position different from the first position. The index is mounted on the fixed body at a position opposed to the position detector when the movable body is located at the first position. The detected positional deviation calculator is configured to calculate a positional deviation amount of the position detector relative to the index, based on a detection result of a position of the index by the position detector. The reference position corrector is configured to correct the reference sheet conveyance position, based on the positional deviation amount of the position detector calculated by the detected positional deviation calculator.

Further, at least one aspect of this disclosure provides an image forming apparatus including the above-described sheet conveying device.

Further, at least one aspect of this disclosure provides a post processing device including a sheet receiving device configured to receive a sheet conveyed from an image forming apparatus and the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
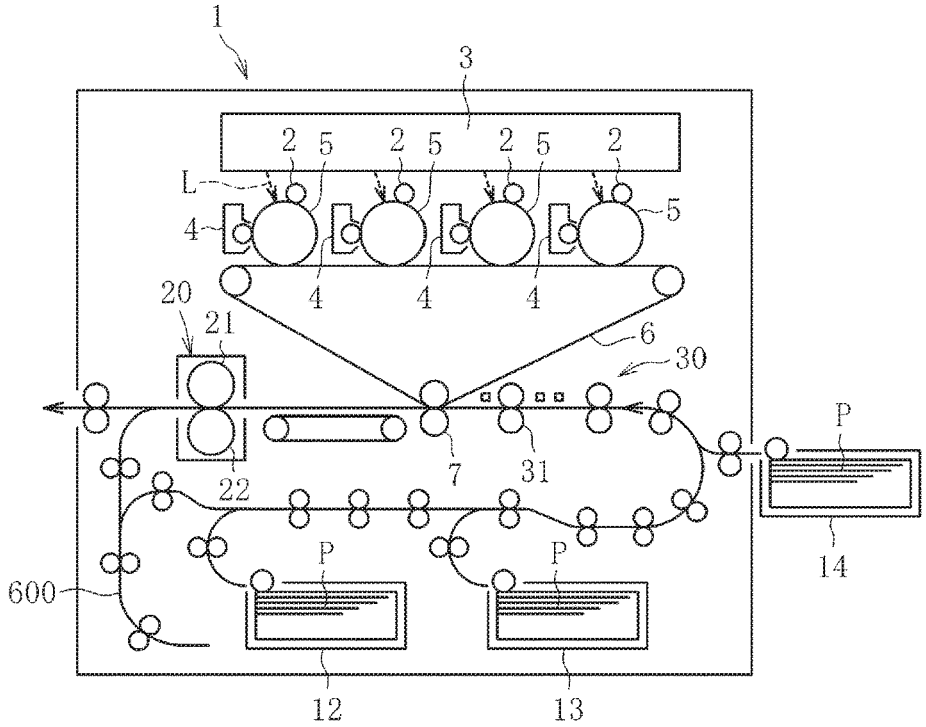
FIG. 1 is a schematic diagram illustrating an entire configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device, an image forming apparatus incorporating the sheet conveying device, and a post processing device incorporating the sheet conveying device.

It is to be noted that elements (for example, mechanical parts and components) having the same functions and shapes are denoted by the same reference numerals throughout the specification and redundant descriptions are omitted.

First, referring to FIG. 1, a description is given of a configuration and functions of an image forming apparatus 1 according to an embodiment of this disclosure.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes charging units 2, an exposure device 3, image forming devices 4, multiple photoconductors 5 (four photoconductors 5, in this case) photoconductors 5, a primary transfer portion 6 (i.e., an intermediate transfer belt 6), a secondary transfer portion 7 (i.e., a secondary transfer roller 7), a first sheet feeding unit 12, a second sheet feeding unit 13, a third sheet feeding unit 14, a fixing device 20, a fixing roller 21, a pressure roller 22, a sheet conveying device 30, and a pair of sheet holding rollers 31.

The charging units 2 uniformly charge respective surfaces of the multiple photoconductors 5.

The exposure device 3 emits respective exposure lights L to the respective surfaces of the photoconductors 5.

The developing devices 4 form a toner image (an image) on the respective surfaces of the multiple photoconductors 5.

The primary transfer portion (the intermediate transfer belt) 6 is a portion onto which the toner image formed on each of the multiple photoconductors 5 is primarily transferred.

The secondary transfer portion (the secondary transfer roller) 7 is a portion to transfer the toner image from the primarily transfer portion 6 to a sheet P.

The first sheet feeding unit 12, the second sheet feeding unit 13, and the third sheet feeding unit 14 are sheet feeding portions (sheet trays), each of which contains the sheet P therein.

The fixing device 20 includes the fixing roller 21 and the pressure roller 22 to fix an unfixed image formed on the sheet P to the sheet P by application of heat by the fixing roller 21 and pressure by the pressure roller 22.

The sheet conveying device 30 conveys the sheet P through a sheet conveyance passage.

The pair of sheet holding rollers 31 functions as a pair of correction rollers to correct the attitude and position of the sheet P while conveying the sheet P.

In addition to the above-described function as a pair of correction rollers, the pair of sheet holding rollers 31 may also function as a pair of timing rollers to adjust a timing of conveyance (i.e., change a conveying speed) of the sheet P to the secondary transfer portion 7.

Further, another pair of timing rollers may be disposed downstream from the pair of sheet holding rollers 31 in the sheet conveying direction.

Figure 2:
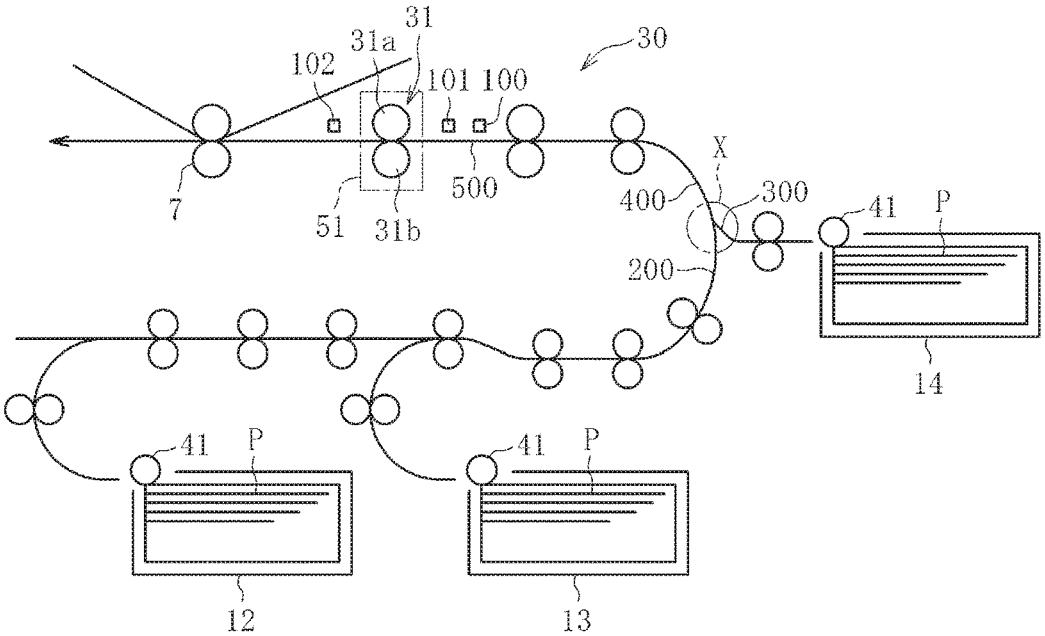
FIG. 2 is a schematic diagram illustrating a pair of sheet holding rollers and parts and units disposed near the pair of sheet holding rollers.

A description is given of regular image forming operations performed in the image forming apparatus 1 according to an embodiment of this disclosure, with reference to FIGS. 1 and 2. FIG. 2 is a schematic diagram illustrating the pair of sheet holding rollers 31 and parts and units disposed near the pair of sheet holding rollers 31.

The charging units 2 uniformly charge the respective surfaces of the multiple photoconductors 5 to a predetermined polarity (a charging process).

Then, based on image data of an original document read by an image reading device or a computer, the exposure device 3 emits laser light L onto the respective charged surfaces of the multiple photoconductors 5 to irradiate the respective surfaces of the photoconductors 5 so as to form respective electrostatic latent images on the respective surfaces of the photoconductors 5 (an exposing process).

The developing devices 4 supply toner onto the respective surfaces of the photoconductors 5 with different colors (for example, yellow, magenta, cyan and black) so that the respective electrostatic latent images formed on the respective surfaces of the photoconductors 5 are developed into respective visible toner images (a developing process).

Then, the respective toner images formed on the respective surfaces of the photoconductors 5 are primarily transferred one on another in layers onto the primarily transfer portion 6 to form a composite color image. Thereafter, the composite color image is secondarily transferred onto the sheet P by the secondary transfer portion 7.

The sheet P is conveyed manually or automatically from a selected one of the first sheet feeding unit 12, the second sheet feeding unit 13 and the third sheet feeding unit 14. For example, when one of the first sheet feeding unit 12 and the second sheet feeding unit 13 disposed inside an apparatus body of the image forming apparatus 1 is selected, the sheet P stored in the selected one of the first sheet feeding unit 12 and the second sheet feeding unit 13 is fed by a sheet feed roller 41 toward a first curved portion 200 of a sheet conveyance passage, as illustrated in FIG. 2.

By contrast, when the third sheet feeding unit 14 disposed outside the apparatus body of the image forming apparatus 1 is selected, the sheet P stored in the third sheet feeding unit 14 is fed by the sheet feed roller 41 toward a second curved portion 300 of the sheet conveyance passage, as illustrated in FIG. 2. The first curved portion 200 and the second curved portion 300 meet at a meeting point X to continuously extend to a third curved portion 400. Therefore, the sheet P fed from any one of the first sheet feeding unit 12, the second sheet feeding unit 13 and the third sheet feeding unit 14 passes the meeting point X to enter the third curved portion 400. Thereafter, the sheet P passes through a straight sheet conveyance passage 500 and reaches the position of the pair of sheet holding rollers 31 that forms an alignment unit 51. Then, the pair of sheet holding rollers 31 corrects the position of the sheet P in the width direction and the rotational direction and conveys the sheet P toward the secondary transfer portion 7.

After the toner image is transferred onto the sheet P at the secondary transfer portion 7, the sheet P is conveyed to the fixing device 20. The sheet P that has been conveyed to the fixing device 20 is sent and held between the fixing roller 21 and the pressure roller 22. Thus, the unfixed toner image on the sheet P is fixed to the sheet P by application of apply and pressure. Consequently, the sheet P is discharged from the image forming apparatus 1.

When a duplex printing mode in which respective images are printed both sides (i.e., a front side and a back side) of the sheet P is selected, a toner image after completion of the charging process, the exposing process and the developing process is transferred onto one side (e.g., the front side) of the sheet P. However, the sheet P is not discharged after the fixing process but is guided to a sheet reverse conveyance passage 600, as illustrated in FIG. 1. The sheet P conveyed to the sheet reverse conveyance passage 600 is switched back (the direction of conveyance of the sheet P is reversed) in the sheet reverse conveyance passage 600, and then is conveyed to the secondary transfer portion 7 again via the first curved portion 200, the third curved portion 400 and the straight sheet conveyance passage 500. Then, a toner image after completion of the charging process, the exposing process and the developing process is transferred onto the other side (e.g., the back side) of the sheet P. At this time, the sheet P is discharged from the image forming apparatus 1 after the fixing process by the fixing device 20.

A series of image forming processes is described above. However, in addition to the above-described image forming operation, the image forming apparatus 1 can form a single color image by any one of the photoconductors 5, or form a composite color image of two or three colors by any two or three of the photoconductors 5.

Next, a description is given of the sheet conveying device 30 according to the present embodiment of this disclosure.

It is to be noted that, hereinafter, "an upstream side in the sheet conveying direction" of the sheet conveyance passage is referred to simply as "an upstream side", "a downstream side in the sheet conveying direction" of the sheet conveyance passage is referred to simply as "a downstream side."

Figure 3A:
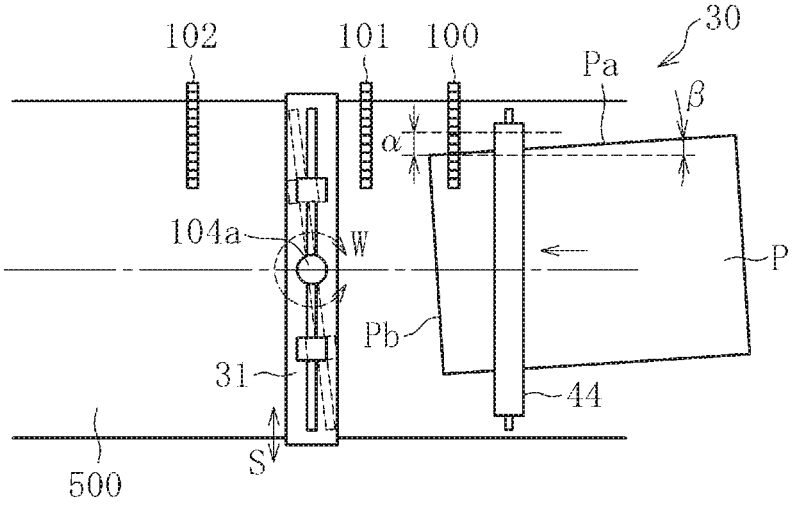
FIG. 3A is a plan view illustrating a schematic diagram of the pair of sheet holding rollers and parts and units disposed near the pair of sheet holding rollers.
Figure 3B:
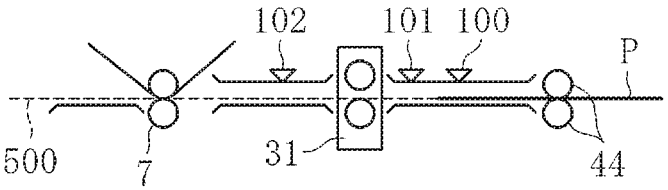
FIG. 3B is a side view illustrating a schematic diagram.

FIG. 3A is a plan view illustrating a schematic diagram of the pair of sheet holding rollers 31 and parts and units disposed near the pair of sheet holding rollers 31. FIG. 3B is a side view of FIG. 3A.

As illustrated in FIGS. 3A and 3B, the sheet conveying device 30 includes multiple CISs 100, 101 and 102 and the pair of sheet holding rollers 31. Each of the multiple CISs 100, 101 and 102 functions as a position detector to detect the position of the sheet P. The pair of sheet holding rollers 31 functions as a sheet conveyor to convey the sheet P as well as a position corrector to correct the position of the sheet P. The CIS 100 is referred to as a "first CIS 100" that functions as a first position detector, the CIS 101 is referred to as a "second CIS 101" that functions as a second position detector and the CIS 102 is referred to as a "third CIS 102" that functions as a third position detector. The first CIS 100, the second CIS 101 and the third CIS 102 are disposed in this order from the upstream side (i.e., the right side of FIG. 2) of the straight sheet conveyance passage 500. Specifically, the first CIS 100 and the second CIS 101 are disposed at the upstream side from the pair of sheet holding rollers 31 and at the downstream side from the pair of sheet conveying rollers 44 that functions as a sheet conveyor that is disposed at one upstream position from the pair of sheet holding rollers 31. By contrast, the third CIS 102 is disposed at the downstream side from the pair of sheet holding rollers 31 and at the upstream side from the secondary transfer portion 7, as illustrated in FIG. 3B. The first CIS 100, the second CIS 101 and the third CIS 102 are disposed parallel to each other relative to the width direction of the sheet P (i.e., a direction perpendicular to the sheet conveying direction). At the same time, the relative positions to the sheet conveying direction and the positional relation to parts and units disposed in the vicinity of the pair of sheet holding rollers 31 are previously determined.

The "CIS" stands for a contact image sensor that contributes to a reduction in size of a device in recent years. The CIS uses small-size LEDs (light emitting diodes) as a light source to directly read an image by linear sensors via lenses. Each of the first CIS 100, the second CIS 101 and the third CIS 102 includes multiple line sensors aligned in the width direction of the sheet P so as to detect a side edge Pa of one end side in the width direction of the sheet P, as illustrated in FIG. 3A.

It is to be noted that the position detector is not limited to a CIS but may be any detector such as photosensors disposed along the width direction of the sheet P as long as the detector detects the side edge Pa of a sheet P.

The pair of sheet holding rollers 31 functions as the alignment unit 51 to perform alignment of lateral correction (i.e., correction to a lateral displacement $\alpha$ of the sheet P illustrated in FIG. 3A) and angular correction (i.e., correction to an angular displacement $\beta$ of the sheet P illustrated in FIG. 3A). Therefore, the pair of sheet holding rollers 31 is rotatable about a shaft 104*a* that is provided at the axial center of the pair of sheet holding rollers 31 in a direction indicated by arrow W in FIG. 3A (i.e., in a rotational direction within a plane of sheet conveyance or a plane of conveyance of a target sheet corresponding to a direction of angular displacement of the sheet P) and is movable in a direction indicated by arrow S in FIG. 3A (i.e., in a width direction of the sheet or the target sheet). It is to be noted that the pair of sheet holding rollers 31 may be rotatable in the direction W about a shaft provided at one axial end thereof.

Figure 4:
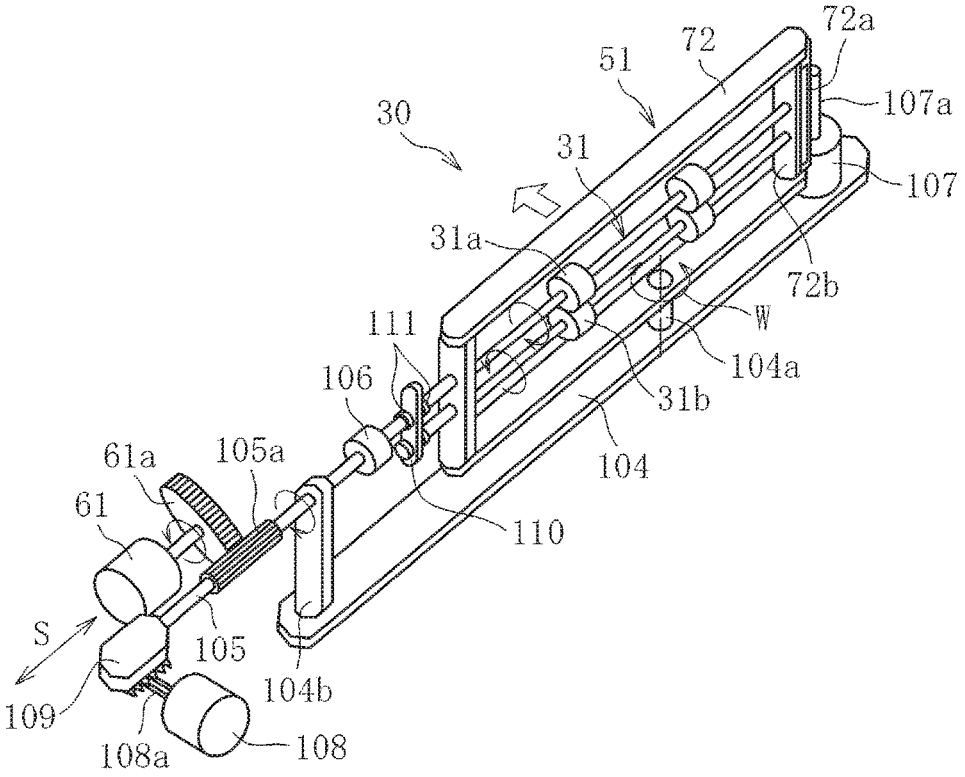
FIG. 4 is a perspective view illustrating the pair of sheet holding rollers and a driving mechanism to drive the pair of sheet holding rollers.

FIG. 4 is a perspective view illustrating the pair of sheet holding rollers 31 and a driving mechanism to drive the pair of sheet holding rollers 31.

As illustrated in FIG. 4, the pair of sheet holding rollers 31 includes multiple pairs of rollers disposed spaced apart from each other in the axial direction thereof. Each of the multiple pairs of rollers of the pair of sheet holding rollers 31 includes a drive roller 31*a* and a driven roller 31*b*. The drive roller 31*a* is rotated by a first drive motor 61 that functions as a drive device (i.e., a first drive device). The driven roller 31*b* is rotated with rotation of the drive roller 31*a*. The pair of sheet holding rollers 31 pivots about the rotation center thereof while holding the sheet P, so as to convey the sheet P.

It is to be noted that, the pair of sheet holding rollers 31 described above has rollers divided in the width direction thereof. However, the structure of a pair of sheet holding rollers is not limited thereto. For example, a pair of sheet holding rollers that is not divided in the axial direction but continuously extends over the whole axial direction thereof may be applied to this disclosure.

The first drive motor 61 is fixed to the frame of the sheet conveying device 30. A drive gear 61*a* is mounted on a motor shaft of the first drive motor 61. The drive gear 61*a* is meshed with a gear 105*a* of a frame side rotary shaft 105 that rotates together with the drive roller 31*a* of the pair of sheet holding rollers 31. According to this configuration, as the first drive motor 61 is driven and rotated, a driving force applied thereby is transmitted to the drive roller 31*a* of the pair of sheet holding rollers 31 via the drive gear 61*a* and the gear 105*a* of the frame side rotary shaft 105.

The frame side rotary shaft 105 is movably supported by an uprising portion 104*b* of a base 104 of the frame so as to move in the direction S together with movement of the pair of sheet holding rollers 31 in the direction S that corresponds to the width direction of the sheet P, as illustrated in FIG. 4. The gear 105*a* of the frame side rotary shaft 105 is sufficiently extended in the axial direction to retain the meshing with the drive gear 61*a* even when the frame side rotary shaft 105 moves in the direction S.

The frame side rotary shaft 105 and the drive roller 31*a* of the pair of sheet holding rollers 31 are drivingly coupled to each other to transmit the driving force via a coupling 106. The coupling 106 is a shaft coupling such as a constant velocity (universal) joint and a universal joint. With the coupling 106, even if a shaft angle of the pair of sheet holding rollers 31 to the frame side rotary shaft 105 is changed along with rotation of the pair of sheet holding rollers 31 in the direction W in FIG. 4 (i.e., the rotational direction in the plane of sheet conveyance to the direction of angular displacement), a speed of rotation does not change, and therefore the driving force is transmitted successfully.

Both the drive roller 31*a* and the driven roller 31*b* of the pair of sheet holding rollers 31 are rotationally supported by a holding member 72 having a substantially rectangular shape, to respective shafts. Further, the drive roller 31*a* and the driven roller 31*b* are supported by the holding member 72 to be respectively movable in the direction S (i.e., the axial direction) to the holding member 72.

Further, the holding member 72 is rotationally supported about the shaft 104*a* to the base 104 that functions as part of the frame of the sheet conveying device 30 of the image forming apparatus 1. Further, the second drive motor 107 that functions as a second drive device is mounted on one end in the width direction of the base 104. The second drive motor 107 rotates the holding member 72 in the direction W about the shaft 104*a* of the base 104. The second drive motor 107 has a motor shaft 62*a*, on a surface of which a gear is mounted. The gear mounted on the motor shaft 62*a* meshes with a gear 72*a* that is mounted on one end in the width direction of the holding member 72. According to this configuration, as the second drive motor 107 rotates in a forward direction or a reverse direction, the holding member 72 and the pair of sheet holding rollers 31 that is held by the holding member 72 rotates together about the shaft 104*a*. Further, a known encoder is mounted on the motor shaft 107*a* of the second drive motor 107, so that the degree of rotation of the pair of sheet holding rollers 31 in the direction W to a reference position of the pair of sheet holding rollers 31 and the direction of rotation of the pair of sheet holding rollers 31 (i.e., the forward direction or the reverse direction) are detected indirectly. Further, a sufficient gap is provided between a supporting part 72*b* disposed at one end of the holding member 72 and the gear 72*a*, so that the respective rotary shafts of the drive roller 31*a* and the driven roller 31*b* do not interfere with the gear 72*a* even if the drive roller 31*a* and the driven roller 31*b* slide to the one end in the width direction.

Further, a third drive motor 108 that functions as a third drive device is disposed on the frame of the sheet conveying device 30 of the image forming apparatus 1 so as to move the pair of sheet holding rollers 31 in the direction S. The third drive motor 108 has a motor shaft 108*a*, on a surface of which a pinion gear is mounted. The pinion gear mounted on the motor shaft 108*a* meshes with a rack gear 109 that is mounted on the other axial end of the frame side rotary shaft 105. The rack gear 109 is rotatably mounted on the frame side rotary shaft 105. According to this configuration, even when the frame side rotary shaft 105 rotates, the rack gear 109 can slide in the direction S without rotating.

Both the drive roller 31*a* and the driven roller 31*b* of the pair of sheet holding rollers 31 are linked to each other via a link 110 so that the drive roller 31*a* and the driven roller 31*b* can move in the direction S together. The link 110 is disposed between the coupling 106 and the holding member 72 to be held by a retaining ring 111 that is mounted on the respective rotary shafts of the drive roller 31*a* and the driven roller 31*b*. According to this configuration, as the third drive motor 108 rotates in the forward direction or the reverse direction, the pair of sheet holding rollers 31 moves in the direction S. Further, a known encoder is mounted on the motor shaft 108*a* of the third drive motor 108, so that the degree of rotation of the pair of sheet holding rollers 31 in the width direction S to a reference position of the pair of sheet holding rollers 31 and the direction of rotation of the pair of sheet holding rollers 31 (i.e., the forward direction or the reverse direction) are detected indirectly.

Now, a description is given of sheet position correction to correct the position of the sheet P, with reference to FIGS. 3A, 3B and 5A through 15.

Figure 5A:
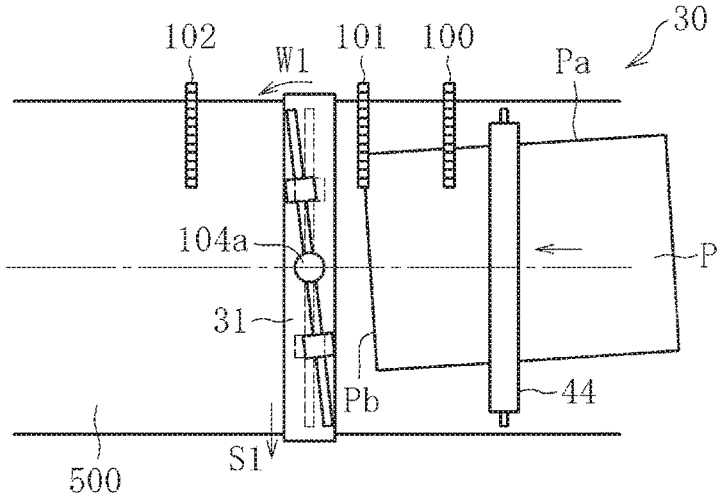
FIG. 5A is a plan view illustrating one step of a process of sheet position correction.
Figure 5B:
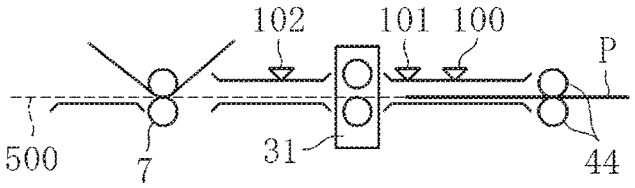
FIG. 5B is a side view illustrating the process of FIG. 5A.

The sheet P fed from any one of the first sheet feeding unit 12, the second sheet feeding unit 13, and the third sheet feeding unit 14 to the sheet conveying device 30 is further conveyed to a downstream side of the sheet conveying direction by the pair of sheet conveying rollers 44, and passes the first CIS 100, as illustrated in FIGS. 3A and 3B. As a leading end Pb of the sheet P arrives at the second CIS 101, as illustrated in FIGS. 5A and 5B, the position of the sheet P is detected (hereinafter, referred to as a "first detection"). Then, based on the result obtained by the first detection, a lateral displacement amount and an angular displacement amount are calculated.

Figure 10:
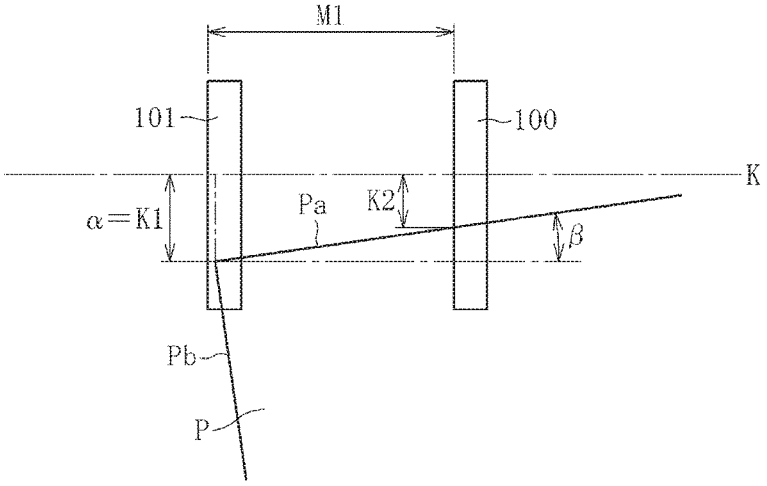
FIG. 10 is a diagram illustrating a position of the sheet for calculating a positional amount of the sheet.

Specifically, the lateral displacement amount of the sheet P based on the result of the first detection is calculated by comparing a position in the width direction of the sheet P detected by the second CIS 101 (i.e., a position of the side edge Pa of the sheet P) and a reference conveyance position K that is indicated by a straight line parallel to the sheet conveying direction illustrated in FIG. 10. Specifically, a distance K1 extending between the position of the sheet P and the reference conveyance position K is calculated as a lateral displacement amount $\alpha$ of the sheet P.

Next, an angular displacement amount of the sheet P is calculated based on a difference of end positions in the width direction of the sheet P detected by the first CIS 100 and the second CIS 101. That is, as illustrated in FIG. 10, when the leading end Pb of the sheet P reaches the second CIS 101, the distance K1 and a distance K2 in the width direction from the reference conveyance position K are detected by the first CIS 100 and the second CIS 101, respectively. Consequently, since a distance M1 in the sheet conveying direction between the first CIS 100 and the second CIS 101 is previously determined, an angular displacement amount $\beta$ to the sheet conveying direction of the sheet P is obtained based on an equation of $\tan \beta = (K1 - K2)/M1$.

Then, based on the lateral displacement amount $\alpha$ of the sheet P and the angular displacement amount $\beta$ of the sheet P obtained as described above, the pair of sheet holding rollers 31 performs a lateral displacement correction of the sheet P and an angular displacement correction of the sheet P, which is hereinafter referred to as a "primary correction."

Figure 11:
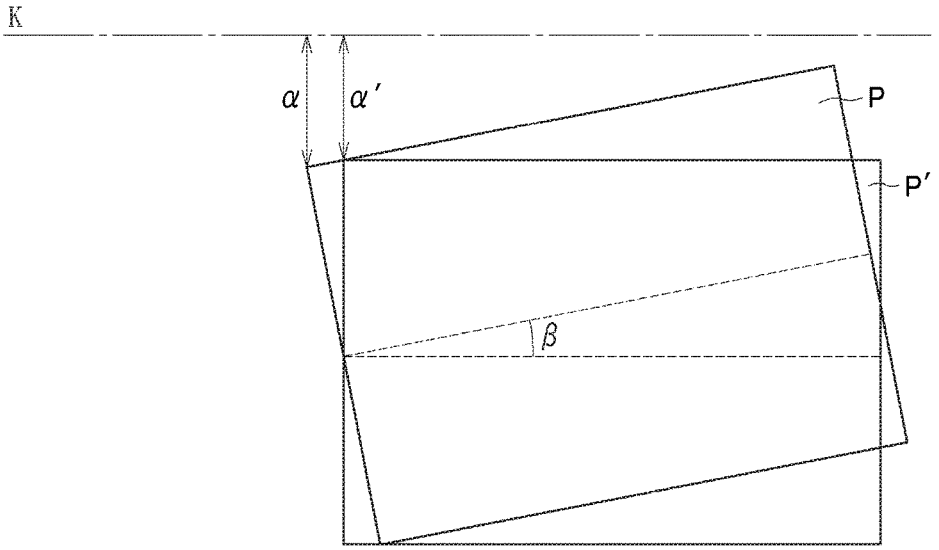
FIG. 11 is a diagram illustrating a lateral displacement amount of the sheet.

The angular displacement of the sheet P is corrected by the amount of the deviation angle β. Further, the lateral displacement of the sheet P is corrected based on the lateral displacement amount α and the deviation angle β. For example, as illustrated in FIG. 11, after correction of the deviation angle β has been corrected, the lateral displacement amount α of the sheet P changes to a lateral displacement amount α'. After having been calculated, the lateral displacement amount α' is regarded as the amount of the lateral displacement correction α' to be corrected by the pair of sheet holding rollers 31. (However, the correction amount α' varies depending on a reference position of the correction of the deviation angle β.)

Figure 12:
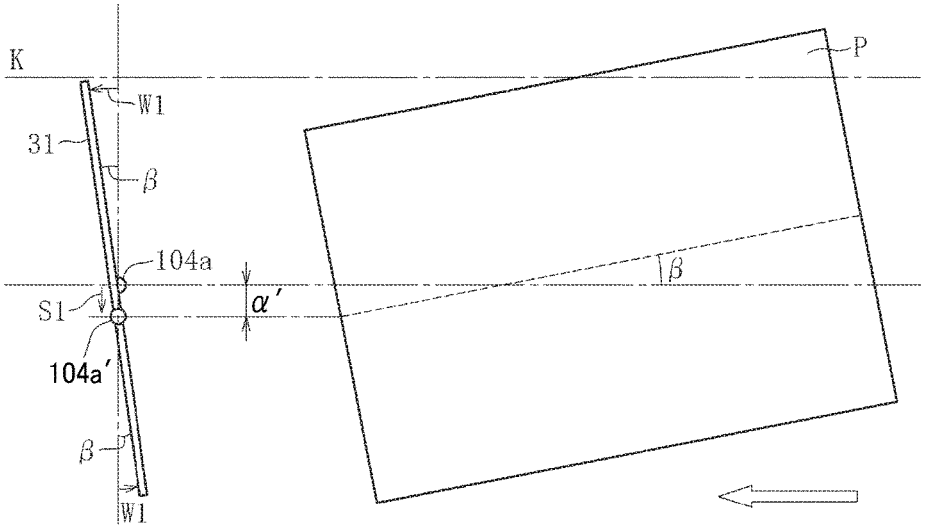
FIG. 12 is a diagram illustrating a pick up and hold operation of the pair of sheet holding rollers.

Here, prior to the first detection, the pair of sheet holding rollers 31 is disposed at the reference position illustrated in FIG. 3A. Before the sheet P reaches the pair of sheet holding rollers 31, the pair of sheet holding rollers 31 perform a pick up and hold operation to move by the amount of movement of the primary correction in an opposite direction to the direction of the primary correction. Specifically, as illustrated in FIG. 12, before holding the sheet P, the pair of sheet holding rollers 31 rotates about a shaft 104*a* in a direction indicated by arrow W1 by the deviation angle β and at the same time moves in parallel thereto in a direction indicated by arrow S1 by the distance of the lateral displacement amount α'. With the rotation, the shaft 104*a* moves to the position indicated as a shaft 104*a*'. The above-described pick up and hold operation is performed after the first detection and before the pair of sheet holding rollers 31 holds the sheet P, as illustrated in FIGS. 5A and 5B.

Figure 6A:
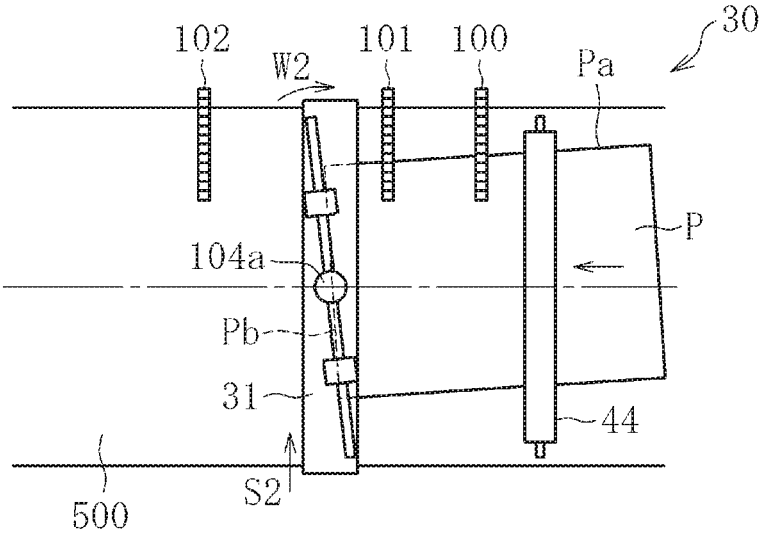
FIG. 6A is a plan view illustrating another subsequent step of the process of sheet position correction.
Figure 6B:
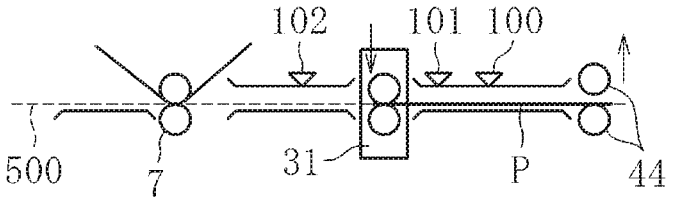
FIG. 6B is a side view illustrating the process of FIG. 6A.

Then, as the leading end Pb of the sheet P reaches the pair of sheet holding rollers 31, the pair of sheet holding rollers 31 holds the sheet P, as illustrated in FIGS. 6A and 6B. At this time, as illustrated in FIG. 6B, the rollers of the pair of sheet conveying rollers 44 disposed upstream from the pair of sheet conveying rollers 44 in the sheet conveying direction separate from each other, so that the rollers of the pair of sheet conveying rollers 44 do not hold the sheet P.

Figure 7A:
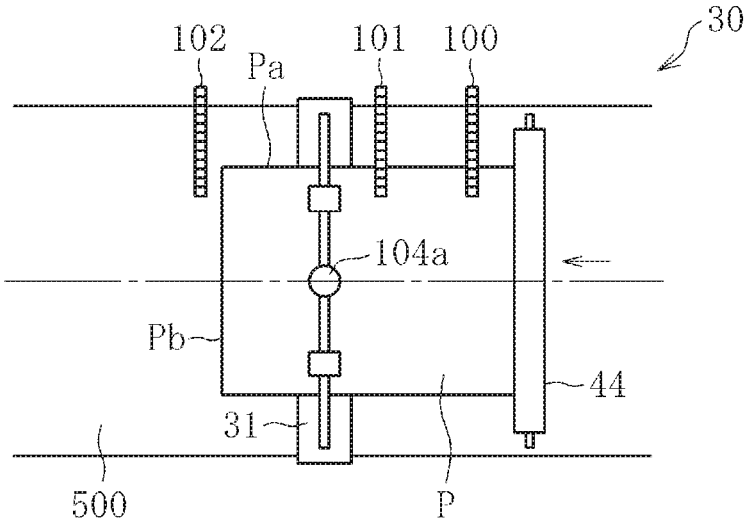
FIG. 7A is a plan view illustrating yet another subsequent step of the process of sheet position correction.
Figure 7B:
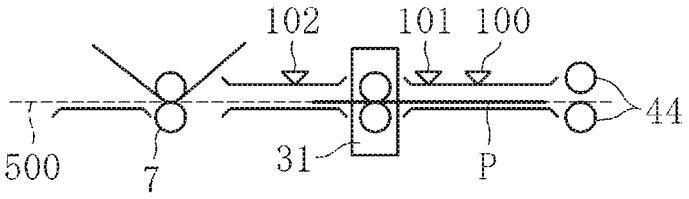
FIG. 7B is a side view illustrating the process of FIG. 7A.

As illustrated in FIG. 6A, when the primary correction starts, the pair of sheet holding rollers 31 rotates, while holding and conveying the sheet P, about the shaft 104*a* in a direction indicated by arrow W2 based on the amount of angular displacement of the sheet P obtained by the result of the first detection. By so doing, the pair of sheet holding rollers 31 corrects the position of the sheet P in the direction of the angular displacement of the sheet P. At the same time, the pair of sheet holding rollers 31 moves in parallel in a direction indicated by arrow S2, so as to correct the position of the sheet P in the width direction. Accordingly, the primary correction performed by the pair of sheet holding rollers 31 is completed, and the position of the sheet P is corrected, as illustrated in FIGS. 7A and 7B.

Figure 13:
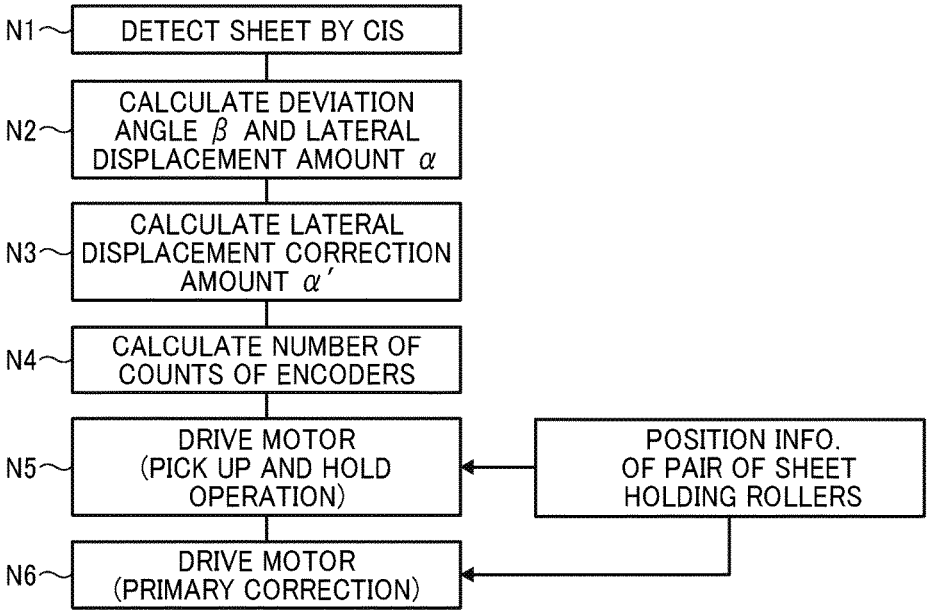
FIG. 13 is a flowchart of a control flow prior to a primary correction.
Figure 14:
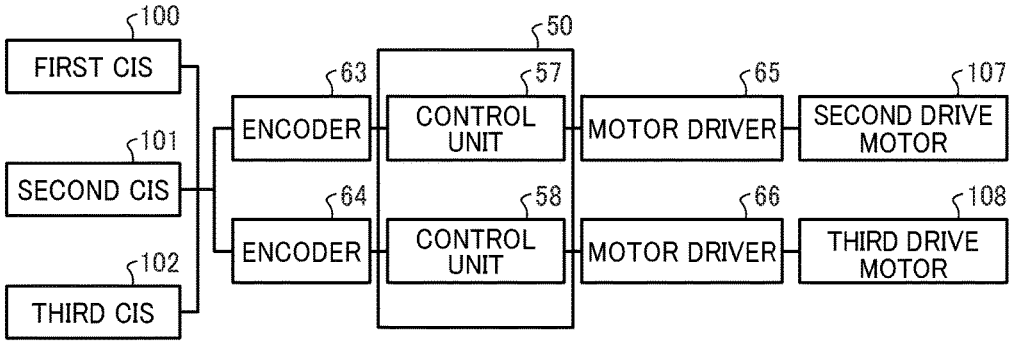
FIG. 14 is a block diagram illustrating a controller that controls the pair of sheet holding rollers.

FIG. 13 is a flowchart of a control flow from the start to the above-described primary correction. FIG. 14 is a block diagram illustrating a controller 50 related to the primary correction.

As illustrated in FIG. 13, the first CIS 100 and the second CIS 101 detect the sheet P, in step N1. Then, the lateral displacement amount α of the sheet P and the angular displacement amount β of the sheet P are calculated, in step N2. Based on the lateral displacement amount α and the angular displacement amount β detected in step N2, the lateral displacement correction amount α' is calculated in step N3. Accordingly, the correction amount of the primary correction (i.e., the angular displacement correction amount β and the lateral displacement correction amount α') are determined.

Based on the detected correction amounts, encoders 63 and 64 (see FIG. 14) calculate the number of counts thereof, in step N4.

Then, the determined numbers of counts are inputted to respective control units 57 and 58 of the controller 50 to drive the pair of sheet holding rollers 31. Thereafter, respective motor drivers 65 and 66 drive the second drive motor 107 and the third drive motor 108 according to the respective numbers of counts of the respective encoders 63 and 64, and then the pair of sheet holding rollers 31 either rotates in the rotation direction within a plane of sheet conveyance (i.e., the direction W) or moves in parallel in the width direction (i.e., the direction S), in step N5. While holding and conveying the sheet P driven by the second drive motor 107 and the third drive motor 108, the pair of sheet holding rollers 31 rotates or moves in a direction opposite the direction of the pick up and hold operation while conveying the sheet P. Accordingly, the pair of sheet holding rollers 31 performs the adjustment and feed operation, in step N6 of the flowchart of FIG. 13. When the pair of sheet holding rollers 31 performs the pick up and hold operation and the primary correction, the respective encoders 63 and 64 feed back the position information of the pair of sheet holding rollers 31 continuously. Accordingly, the pair of sheet holding rollers 31 is controlled to move by the determined amount of movement. According to the above-described operation, the position of the pair of sheet holding rollers 31 after completion of the primary correction approaches the reference position. However, it is not determined that the pair of sheet holding rollers 31 returns to the reference position by performing the secondary correction, which is described below.

As described above, in the present embodiment, the positional correction of the sheet P (i.e., the primary correction) is performed based on the lateral and angular displacement amounts of the sheet P obtained by the detection result of the first CIS 100 and the second CIS 101. However, there is a case that the primary correction alone is not sufficient to achieve the precise position of the sheet P.

Specifically, after the primary detection, a force is applied to the sheet P by the pair of sheet holding rollers 31 when the sheet P is held by the pair of sheet holding rollers 31. Therefore, it is likely that a further positional deviation occurs to the sheet P. Further, when the pair of sheet holding rollers 31 corrects the position of the sheet P or conveys the sheet P toward the downstream side in the sheet conveying direction, it is likely that a further positional deviation is generated to the sheet P. Further, it is also likely that a correction error occurs in the primary correction.

In order to address these inconveniences, the sheet conveying device 30 according to the present embodiment performs a secondary correction after the primary correction so as to further correct the position of the sheet P.

Now, a description is given of the secondary correction.

Figure 8A:
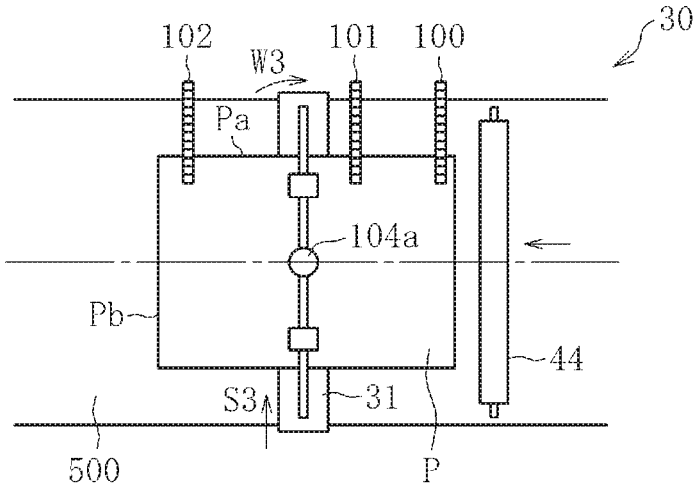
FIG. 8A is a plan view illustrating yet another subsequent step of the process of sheet position correction.
Figure 8B:
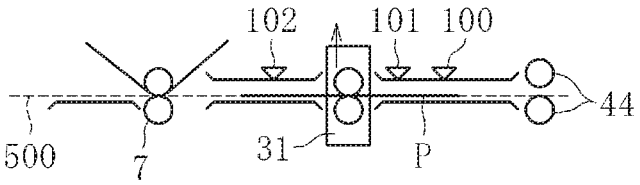
FIG. 8B is a side view illustrating the process of FIG. 8A.

After the primary correction, as the leading end Pb of the sheet P arrives at the third CIS 102, as illustrated in FIGS. 8A and 8B, the position of the sheet P is detected again by the second CIS 101 and the third CIS 102 (hereinafter, referred to as a "second detection"). Then, based on the result obtained by the second detection, lateral and angular displacement amounts of the sheet P are calculated.

The lateral and angular displacement amounts of the sheet P based on the second detection are calculated by the same steps as the first detection, based on the detection results obtained by the upstream side CIS and the downstream side CIS. That is, the lateral displacement amount at is obtained based on the position of the sheet P in the width direction obtained by the third CIS 102 (i.e., the position of the side edge Pa in the width direction). Further, the angular displacement amount of the sheet P is calculated based on the respective positions in the width direction of the sheet P obtained by the second CIS 101 and the third CIS 102 and the distance between the second CIS 101 and the third CIS 102. (In second detection, the position of the sheet P is detected by the second CIS 101 that is replaced by the first CIS 100 used in the first detection and the third CIS 102 that is replaced by the second CIS 101 used in the first detection.)

Then, based on the lateral and angular displacement amounts of the sheet P calculated based on the detection result obtained through the second detection, the pair of sheet holding rollers 31 moves, while conveying the sheet P, in a direction indicated by arrow S3 in FIG. 8A, and rotates about the shaft 104*a* in a direction indicated by arrow W3. By so doing, the secondary correction is performed.

Figure 15:
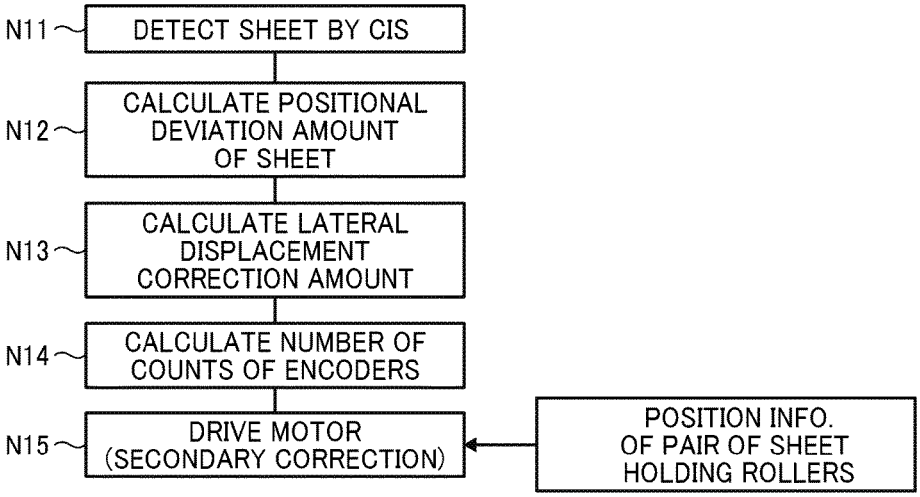
FIG. 15 is a flowchart of a control flow of a secondary correction.

FIG. 15 is a flowchart of a control flow of the secondary correction.

In the secondary correction, the second CIS 101 and the third CIS 102 detect the sheet P, in step N11. Then, with the same steps as the primary correction, the lateral and angular displacement amount of the sheet Pare calculated, in step N12. Then, lateral and angular displacement correction amounts are calculated based on the calculated lateral and angular displacement amounts, in step N13, and the number of counts of each of the encoders 63 and 64 is calculated based on the calculated correction amounts, in step N14. Thereafter, the motor drivers 65 and 66 drive the second drive motor 107 and the third drive motor 108 according to the respective numbers of counts of the respective encoders 63 and 64, and then the pair of sheet holding rollers 31 performs the secondary correction, in step N15.

During the secondary correction, the second CIS 101 and the third CIS 102 continuously detect the position information of the sheet P after the start of the secondary correction. Then, the positional deviation amount of the sheet P is detected based on the position information and is fed back to the controller 50. Accordingly, the lateral displacement correction amount of the sheet P and the angular displacement correction amount of the sheet P are updated continuously. By performing the feedback control as described above, the positional deviation of the sheet P that may occur in the secondary correction and the correction error in the secondary correction can be modified, and therefore the correction can be performed with higher accuracy. However, the secondary correction may be performed without the feedback control, specifically, may be performed based on the correction amount calculated on arrival of the leading end of the sheet P at the third CIS 102.

Figure 9A:
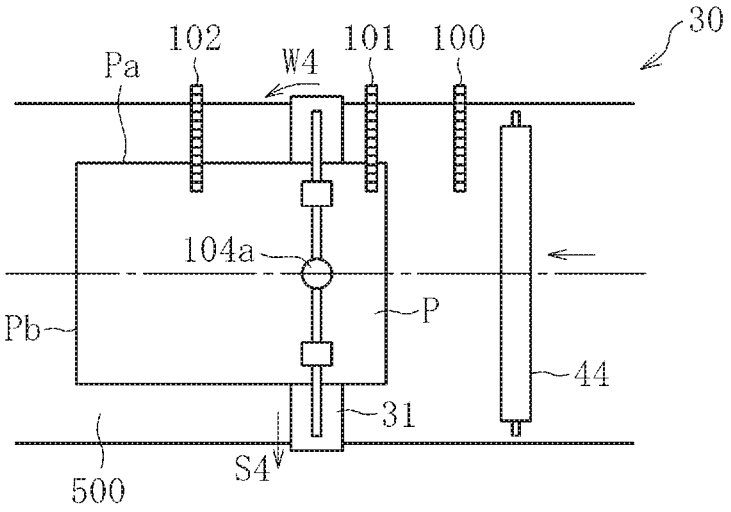
FIG. 9A is a plan view illustrating yet another subsequent step of the process of sheet position correction.
Figure 9B:
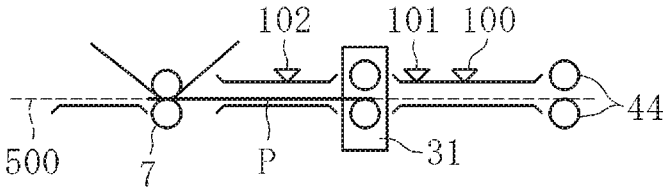
FIG. 9B is a side view illustrating the process of FIG. 9A.

As described above, the sheet P after completion of the primary correction and the secondary correction is conveyed by the pair of sheet holding rollers 31 toward the secondary transfer portion 7. As the sheet P reaches the secondary transfer portion 7, as illustrated in FIGS. 9A and 9B, the pair of sheet holding rollers 31 separates the sheet P and returns to the reference position for preparation of sheet position correction and conveyance of a subsequent sheet P. (In FIG. 9A, the pair of sheet holding rollers 31 returns to the reference position by moving in a direction indicated by arrow S4 and rotating about the shaft 104*a* in a direction indicated by arrow W4.)

Figure 16:
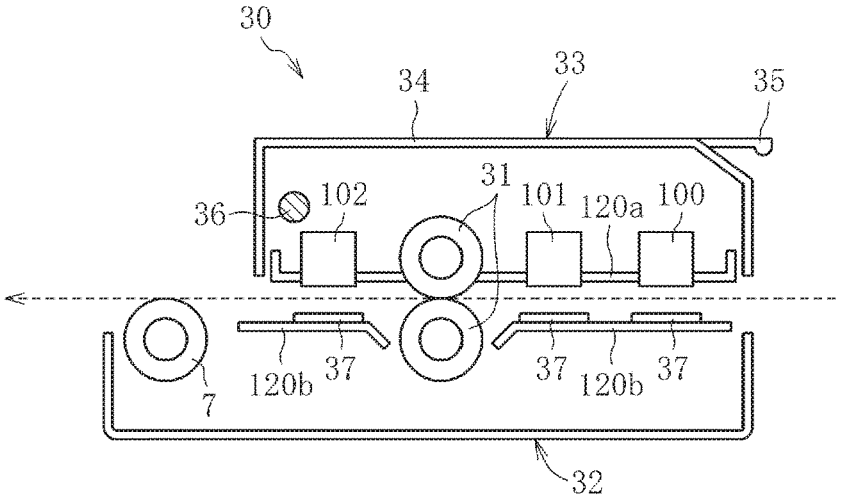
FIG. 16 is a diagram illustrating a sheet conveying device according to an embodiment of this disclosure.
Figure 17:
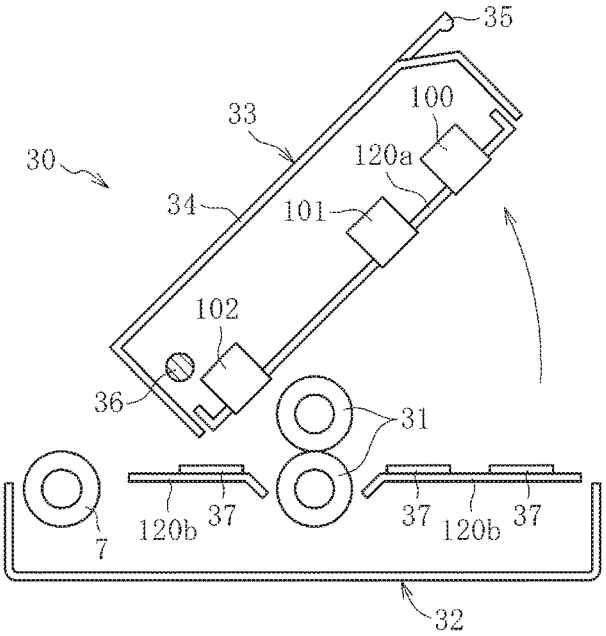
FIG. 17 is a diagram illustrating a movable member in an open state.

FIG. 16 is a diagram illustrating a schematic configuration of the sheet conveying device 30 according to an embodiment of this disclosure. FIG. 17 is a diagram illustrating the movable member 33 in an open state.

As illustrated in FIG. 16, in order to perform maintenance work easily, the sheet conveying device 30 according to the present embodiment of this disclosure is detachably attached to the apparatus body of the image forming apparatus 1 and includes the pair of sheet holding rollers 31, the first CIS 100, the second CIS 101, the third CIS 102, an upper sheet conveyance guide 120*a*, a lower sheet conveyance guide 120*b* and the secondary transfer portion (the secondary transfer roller) 7 integrally as a single unit. As illustrated in FIG. 17, in order to easily remove a jammed sheet or sheets caught inside the sheet conveying device 30 according to the present embodiment of this disclosure, an upper part of the sheet conveying device 30 in the drawing is openably closable (rotatable) to a lower part thereof. That is, the sheet conveying device 30 includes a fixed member 32 and a movable member 33. The fixed member 32 corresponds to the lower part that is fixed and is not open or close. By contrast, the movable member 33 corresponds to the upper portion that opens and closes. The movable member 33 moves between a first position in a closed state as illustrated in FIG. 16 and a second position in an open state as illustrated in FIG. 17.

The fixed member 32 includes the pair of sheet holding rollers 31, the lower sheet conveyance guide 120*b* and the secondary transfer portion 7. On the other hand, the movable member 33 includes the upper sheet conveyance guide 120*a*, the first CIS 100, the second CIS 101 and the third CIS 102. The movable member 33 is disposed to rotate or swing about a support shaft 36 that is fixed to the fixed member 32, in a vertical direction. Further, the movable member 33 includes a cover 34 to cover the upper part of the upper sheet conveyance guide 120*a* and the upper part of each of the first CIS 100, the second CIS 101 and the third CIS 102. A handle 35 is disposed upstream from the cover 34 in the sheet conveying direction. The handle 35 is manually pushed up to rotate (swing) the movable member 33 about the support shaft 36 in an upward direction. By so doing, the movable member 33 is moved to the open state (i.e., the state illustrated in FIG. 17). Accordingly, the upper sheet conveyance guide 120*a*, the first CIS 100, the second CIS 101 and the third CIS 102 move to a retracted position that is upwardly separated from the lower sheet conveyance guide 120*b*. Consequently, a paper jam handling, such as removal of a jammed sheet or sheets, can be performed easily.

However, in a case in which a CIS is mounted on a movable member, when the movable member opens and closes, it is likely that the position of the CIS after movement of the movable member changes from the position before the movement of the movable member. When the position of the CIS changes after the movement of the movable member, the positional deviation amount of the sheet obtained based on the detection result of the CIS changes. Due to this positional deviation, the accuracy in sheet position correction of the sheet deteriorates.

In order to address this inconvenience, the sheet conveying device 30 according to the present embodiment prevents deterioration of accuracy in sheet position correction of the sheet due to the positional deviation of the CIS by grasping the positional deviation amount of the CIS to correct the reference conveyance position of the sheet based on the positional deviation amount of the CIS.

A detailed description of the sheet position correction is given as follows.

As illustrated in FIG. 16, the sheet conveying device 30 according to the present embodiment includes an index 37 mounted on the fixed member 32. The index 37 functions as a reference position to calculate the positional deviation amount of each of the first CIS 100, the second CIS 101 and the third CIS 102. Specifically, the index 37 includes a white sheet attached to an upper face of the lower sheet conveyance guide 120*b* by a double-sided adhesive tape, for example.

Figure 18:
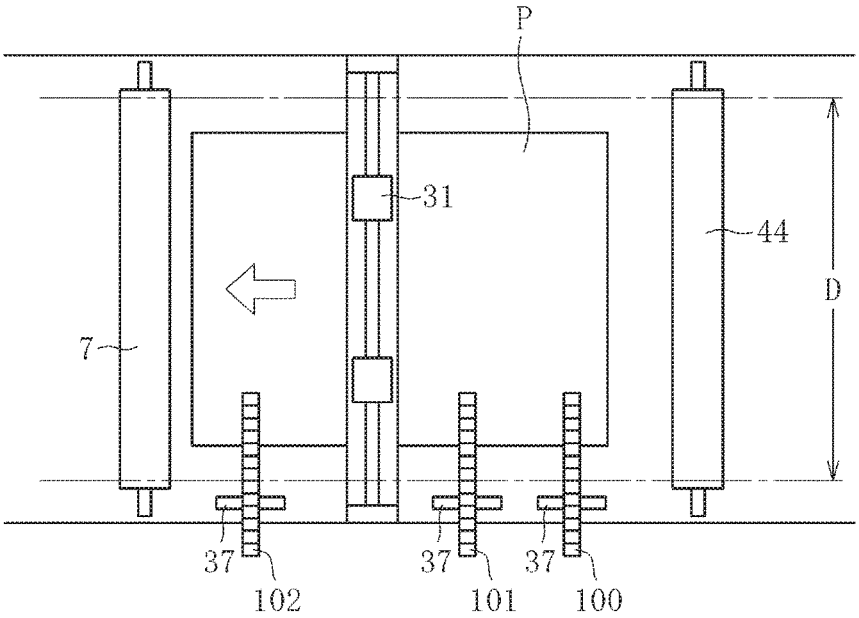
FIG. 18 is a plan view illustrating positional relations of an index and each CIS.

FIG. 18 is a plan view illustrating positional relations of the index 37 and each of the first CIS 100, the second CIS 101 and the third CIS 102. It is to be noted that the configurations illustrated in FIGS. 3 and 18 are basically identical to each other even though the layouts of these configurations are opposite to each other. Specifically, the first CIS 100, the second CIS 101 and the third CIS 102 are disposed lower from the sheet conveyance passage in FIG. 18, which is vertically opposite to the configuration in FIG. 3.

As illustrated in FIG. 18, the index 37 is disposed at a position opposed to each of the first CIS 100, the second CIS 101 and the third CIS 102. Here, the position opposed to each of the first CIS 100, the second CIS 101 and the third CIS 102 is a position where the movable member 33 is located at the first position in the closed state as illustrated in FIG. 16 and the first CIS 100, the second CIS 101 and the third CIS 102 are disposed opposed to the lower sheet conveyance guide 120*b* (i.e., the fixed member 32) to be capable of detecting the position of the sheet P. Further, the index 37 is disposed outside in the width direction from a conveyance width D (that is, the maximum conveyance width) in which a conveyable sheet P having the maximum width size passes.

Figure 19:
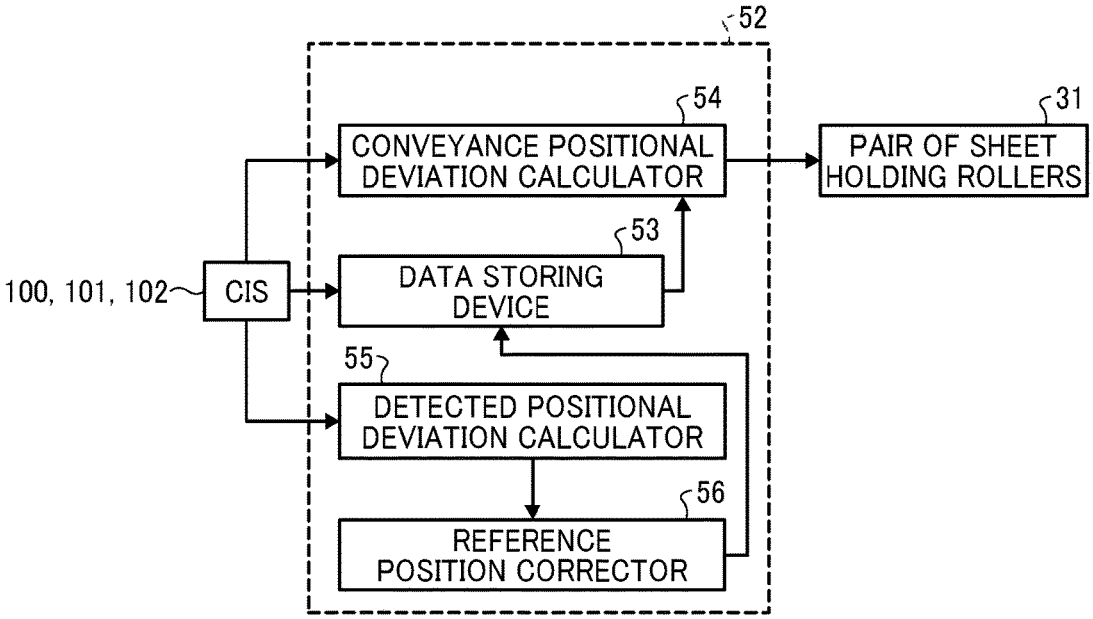
FIG. 19 is a block diagram illustrating a controller that controls calculation of a positional deviation amount of the CIS and correction of a reference conveyance position of sheet.

FIG. 19 is a block diagram illustrating a controller 52 that controls calculation of a positional deviation amount of the CIS and correction of a reference conveyance position of a sheet.

As illustrated in FIG. 19, the controller 52 includes a data storing device 53, a conveyance positional deviation calculator 54, a detected positional deviation calculator 55 and a reference position corrector 56. The data storing device 53 stores a reference conveyance position of a sheet and the relative position of each of the first CIS 100, the second CIS 101 and the third CIS 102 to the index 37. The conveyance positional deviation calculator 54 calculates a positional deviation amount of the sheet to the reference conveyance position. The detected positional deviation calculator 55 calculates the positional deviation amount of each of the first CIS 100, the second CIS 101 and the third CIS 102. The reference position corrector 56 corrects the reference conveyance position based on the positional deviation amount of each of the first CIS 100, the second CIS 101 and the third CIS 102.

Figure 20:
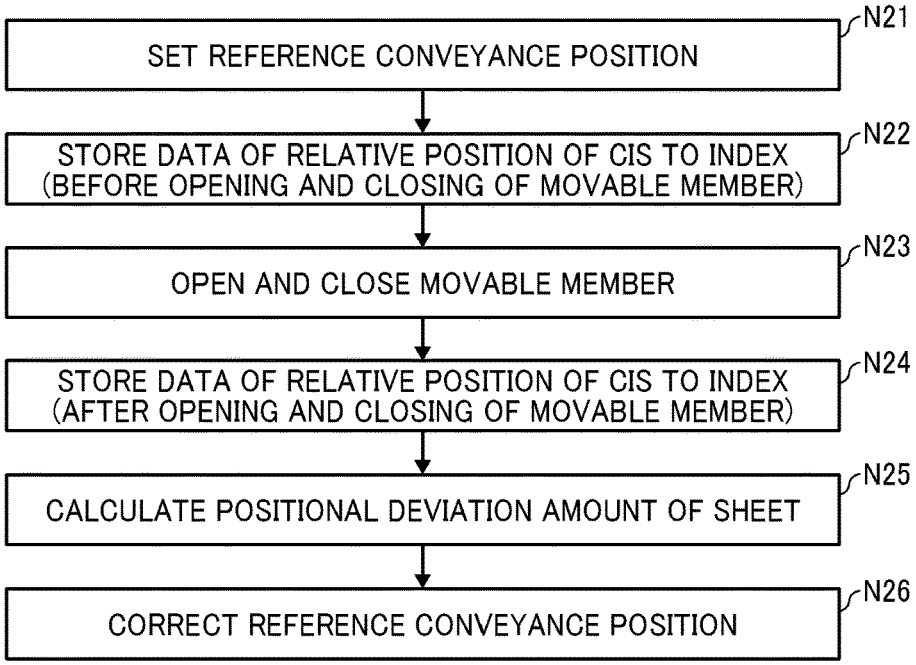
FIG. 20 is a flowchart of a control flow from setting to correction of the reference conveyance position.

Next, a description is given of processes and functions of the controller 52 and a control flow performed by the controller 52 from setting to correction of the reference conveyance position, with reference to FIG. 20.

Figure 21:
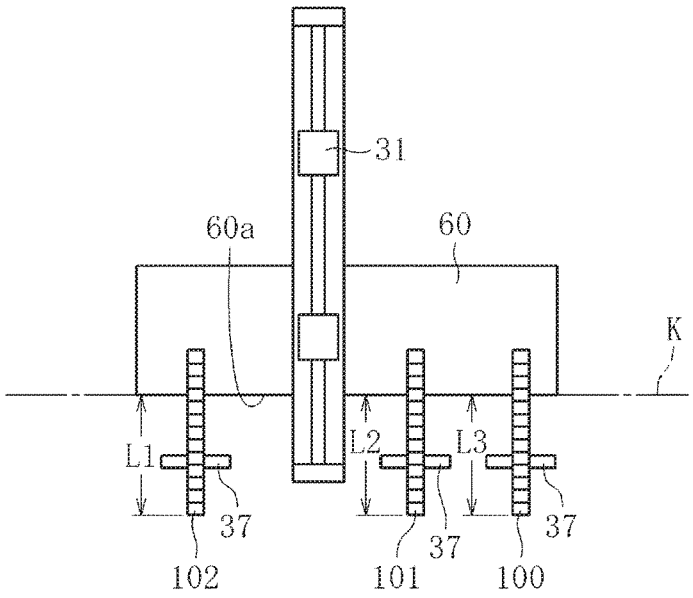
FIG. 21 is a diagram illustrating the setting of the reference conveyance position.

FIG. 20 is a flowchart of the control flow by the controller 52 from setting to correction of the reference conveyance position. FIG. 21 is a diagram illustrating the setting of the reference conveyance position.

First, the reference conveyance position is set. The reference conveyance position is set prior to the start of the image forming apparatus 1 (for example, the adjustment process prior to factory shipping) to set the reference conveyance position according to the relation of a relative position to each of the first CIS 100, the second CIS 101 and the third CIS 102, in step N21. Specifically, as illustrated in FIG. 21, a reference sheet 60 is placed as a member used for setting a conveyance reference, at a position opposed to the first CIS 100, the second CIS 101 and the third CIS 102. The reference sheet 60 has a straight edge portion 60*a* and the first CIS 100, the second CIS 101 and the third CIS 102 detect the straight edge portion 60*a* extending along the sheet conveying direction. Consequently, lateral distances L1, L2 and L3 from the respective CISs 100, 101 and 102 to the straight edge portion 60*a* of the reference sheet 60 are stored in the data storing device 53. The lateral distances L1, L2 and L3 are used as position information to determine the reference conveyance position. Accordingly, the position of the straight edge portion 60*a* of the reference sheet 60 is set as a reference conveyance position K. After the reference conveyance position has been set, the reference sheet 60 is no longer used. Therefore, the reference sheet 60 is removed from the image forming apparatus 1.

Thereafter, as the image forming apparatus 1 is started, the position of a sheet is corrected based on the reference conveyance position that has been set as described above. When the sheet is conveyed, the conveyance positional deviation calculator 54 calculates a positional deviation amount of the sheet to the reference conveyance position, based on the position information of the sheet detected by the first CIS 100, the second CIS 101 and the third CIS 102. Then, based on the calculated positional deviation amount of the sheet, the pair of sheet holding rollers 31 corrects the position of the sheet. It is to be noted that details of the method of calculation of the positional deviation amount and the operations of the sheet position correction are described above.

Figure 22:
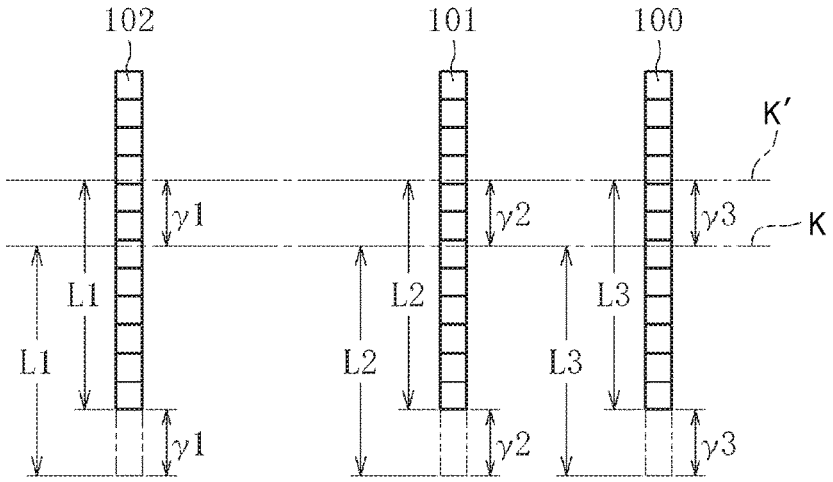
FIG. 22 is a diagram illustrating a positional deviation of the reference conveyance position of the sheet caused by a positional deviation of each CIS.
Figure 23:
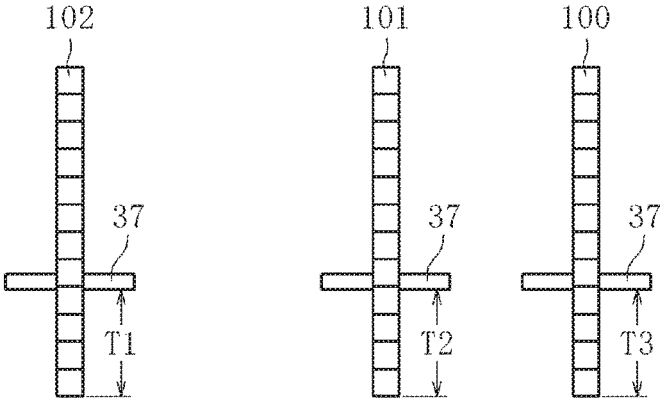
FIG. 23 is a diagram illustrating a relative position of each CIS to a corresponding index.
Figure 24:
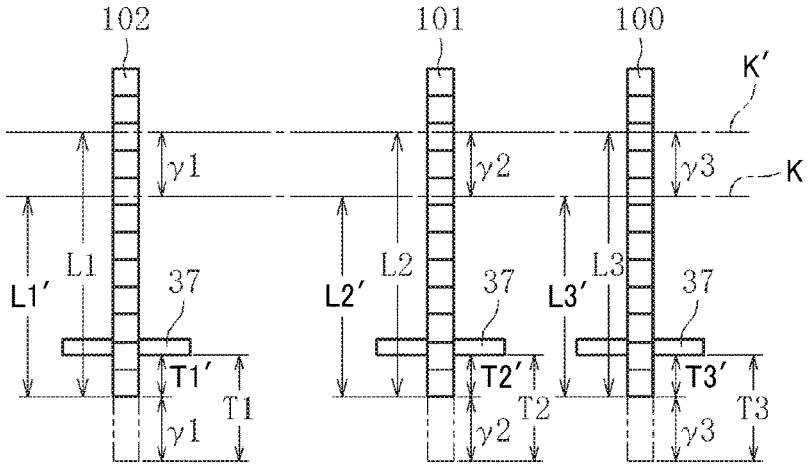
FIG. 24 is a diagram illustrating the calculation of a positional deviation amount of the CIS and the correction of the reference conveyance position.

FIG. 22 is a diagram illustrating a positional deviation of the reference conveyance position of the sheet caused by a positional deviation of each of the first CIS 100, the second CIS 101 and the third CIS 102. FIG. 23 is a diagram illustrating a relative position of each of the first CIS 100, the second CIS 101 and the third CIS 102 to the corresponding indexes 37. FIG. 24 is a diagram illustrating the calculation of the positional deviation amounts of the first CIS 100, the second CIS 101 and the third CIS 102 and the correction of the reference conveyance position.

Here, if the movable member 33 is opened and closed, it is likely that the position of each of the first CIS 100, the second CIS 101 and the third CIS 102 is moved to a different position along with the movement of the movable member 33. For example, in a case in which the respective positions of the first CIS 100, the second CIS 101 and the third CIS 102 are moved in the width direction of the sheet (i.e., an upward direction in FIG. 22) by respective distances γ1, γ2 and γ3, the position of the reference conveyance position K (i.e., the respective positions of the lateral distances L1, L2 and L3 from the respective ends of the first CIS 100, the second CIS 101 and the third CIS 102) is moved along with the movement of the CISs 100, 101 and 102 by the same distance, as illustrated in FIG. 22. Consequently, the reference conveyance position K is changed to a reference conveyance position K' indicated by a broken line in FIG. 22.

However, under this condition, the sheet position correction of the sheet cannot be performed with high accuracy. Therefore, positional deviation amounts (distances) γ1, γ2 and γ3 of the respective CISs 100, 101 and 102 are calculated to correct the reference conveyance position by the positional deviation amounts.

In order to address this condition, in the present embodiment, prior to an opening and closing operation of the movable member 33 (for example, after completion of the setting of the reference conveyance position or during adjustment performed before the start of sheet conveyance), the relative positions of the first CIS 100, the second CIS 101 and the third CIS 102 to the respective indexes 37 are detected and stored as respective initial positions of the first CIS 100, the second CIS 101 and the third CIS 102 (i.e., positions of the CISs 100, 101 and 102 prior to the opening and closing operation of the movable member 33), in step N22. Specifically, with the movable member 33 being closed and the CISs 100, 101 and 102 being opposed to the respective indexes 37, the CISs 100, 101 and 102 detect the respective indexes 37. Then, lateral distances T1, T2 and T3 from the end portions of the first CIS 100, the second CIS 101 and the third CIS 102 to the corresponding indexes 37 are stored in the data storing device 53, as illustrated in FIG. 23.

Thereafter, when another opening and closing operation of the movable member 33 is performed, in step N23, the respective relative positions of the first CIS 100, the second CIS 101 and the third CIS 102 to the corresponding indexes 37 (i.e., the positions of the CISs 100, 101 and 102 after the opening and closing operation of the movable member 33) are detected and stored in the data storing device 53 again. Specifically, as illustrated in FIG. 24, lateral distances T1', T2' and T3', which are lateral distances from the end portions of the CISs 100, 101 and 102 to the corresponding indexes 37 after the opening and closing operation of the movable member 33, are stored in the data storing device 53, in step N24.

Then, based on the preceding relative position information (i.e., the lateral distances T1, T2 and T3) firstly obtained and subsequent relative position information (i.e., the lateral distances T1', T2' and T3') obtained again after the preceding relative position information, the detected positional deviation calculator 55 calculates the positional deviation amounts γ1, γ2 and γ3 of the first CIS 100, the second CIS 101 and the third CIS 102 to the corresponding indexes 37, in step N25. The positional deviation amounts γ1, γ2 and γ3 of the first CIS 100, the second CIS 101 and the third CIS 102 to the corresponding indexes 37 are calculated with Formulae (1), (2) and (3) described below. It is to be noted that the positional deviation amounts γ1, γ2 and γ3 are not constantly the identical values to each other. For example, when the first CIS 100, the second CIS 101 and the third CIS 102 are moved in the rotational direction of a sheet conveyed thereto, the positional deviation amounts γ1, γ2 and γ3 are different values from each other.

$$\gamma 1 = T1 - T1' \quad \text{Formula (1),}$$

$$\gamma 2 = T2 - T2' \quad \text{Formula (2), and}$$

$$\gamma 3 = T3 - T3' \quad \text{Formula (3).}$$

Then, based on the calculated positional deviation amounts γ1, γ2 and γ3 of the first CIS 100, the second CIS 101 and the third CIS 102, respectively, the reference position corrector 56 corrects the lateral distances L1, L2 and L3 that are the position information of the reference conveyance positions stored in the data storing device 53. Specifically, corrected lateral distances L1', L2' and L3' are obtained by subtracting the positional deviation amounts γ1, γ2 and γ3 of the first CIS 100, the second CIS 101 and the third CIS 102 from the lateral distances L1, L2 and L3, as shown in the following Formulae (4), (5) and (6).

$$L1' = L1 - \gamma 1 \quad \text{Formula (4),}$$

$$L2' = L2 - \gamma 2 \quad \text{Formula (5), and}$$

$$L3' = L3 - \gamma 3 \quad \text{Formula (6).}$$

Thus, by correcting the lateral distances L1, L2 and L3 as the position information of the reference conveyance position, the corrected lateral distances L1', L2' and L3' are updated as revised position information and stored in the data storing device 53. Accordingly, the reference conveyance position is corrected to a correct position (i.e., the reference conveyance position K indicated with a broken line), in step N26.

In a case in which the movable member 33 is further opened and closed, new relative position information of the first CIS 100, the second CIS 101 and the third CIS 102 to the corresponding indexes 37 (e.g., lateral distances T1", T2" and T3") are obtained. Then, based on this new relative position information (i.e., the lateral distances T1", T2" and T3") and the previous relative position information (i.e., the lateral distances T1', T2' and T3'), updated positional deviation amounts of the first CIS 100, the second CIS 101 and the third CIS 102 are calculated with the above-described Formulae (1), (2) and (3). Then, based on the calculated positional deviation amounts of the first CIS 100, the second CIS 101 and the third CIS 102, the reference position corrector 56 corrects the updated lateral distances L1', L2' and L3' that are the position information of the reference conveyance positions with the above-described Formulae (4), (5) and (6).

Thereafter, each time the opening and closing operation of the movable member 33 is performed, new relative position information of the first CIS 100, the second CIS 101 and the third CIS 102 to the corresponding indexes 37 are obtained again. Then, revised positional deviation amounts of the CISs 100, 101 and 102 are calculated by comparing the obtained new relative position information with the previous relative position information. Then, based on the calculated revised positional deviation amounts, the previous reference conveyance position is corrected to an updated reference conveyance position.

As described above, the fixed member 32 of the sheet conveying device 30 according to the present embodiment is provided with the indexes 37 as respective reference positions to calculate the respective positional deviation amounts of the CISs 100, 101 and 102. According to this configuration, even when the positions of the CISs 100, 101 and 102 are moved along with movement of the movable member 33, the positional deviation amounts of the CISs 100, 101 and 102 can be calculated based on the respective relative positions of the CISs 100, 101 and 102 the corresponding indexes 37. Consequently, the reference conveyance position is corrected reliably. Accordingly, a detection error or errors of the positional deviation of a sheet due to the positional deviation of each CIS can be reduced, and therefore the position correction of the sheet can be performed with high accuracy.

Further, as illustrated in FIG. 16, in the present embodiment, the multiple CISs are attached to a single, common conveyance guide that is integrally formed with the multiple CISs. To be more specific, the first CIS 100, the second CIS 101 and the third CIS 102 are attached to the upper sheet conveyance guide 120*a* that is a single member integrally formed with the first CIS 100, the second CIS 101 and the third CIS 102. That is, the first CIS 100, the second CIS 101 and the third CIS 102 are mounted on the upper sheet conveyance guide 120*a* integrally as a single unit. According to this configuration, when compared with a configuration in which the first CIS 100, the second CIS 101 and the third CIS 102 are attached to respective individual members, variation in positions of the first CIS 100, the second CIS 101 and the third CIS 102 generated by assembly errors of parts can be reduced, and therefore the accuracy in detection of a sheet position can be enhanced.

By contrast, the pair of sheet holding rollers 31 is mounted on the fixed member 32 that is a device different and separated from the movable member 33 on which the first CIS 100, the second CIS 101 and the third CIS 102 are mounted. According to the configuration of the present embodiment, it is less likely that vibration generated when the pair of sheet holding rollers 31 moves is transmitted to the first CIS 100, the second CIS 101 and the third CIS 102. As a result, a reduction in detection accuracy of the first CIS 100, the second CIS 101 and the third CIS 102 due to the vibration.

Figure 25:
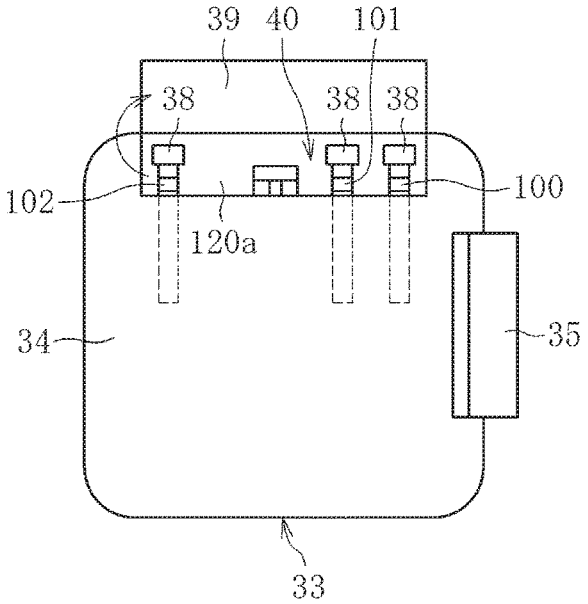
FIG. 25 is a diagram illustrating a configuration in which the movable member includes an opening that is openable and closable.

Further, FIG. 25 is a diagram illustrating a configuration in which the movable member 33 includes an opening 40 that is openable and closable on the cover 34. As illustrated in FIG. 25, the opening 40 having a lid 39 that opens and closes by rotating or swinging about one end side of the opening 40 is provided at a position on the cover 34, facing the first CIS 100, the second CIS 101 and the third CIS 102. Specifically, as illustrated in FIG. 25, the first CIS 100, the second CIS 101 and the third CIS 102 are fixed with fixing members 38 to the upper sheet conveyance guide 120*a*. Since the opening 40 is provided above the fixing members 38, the first CIS 100, the second CIS 101 and the third CIS 102 can be easily attached to or removed from the sheet conveying device 30 through the opening 40.

As described above, the embodiments are provided to be applied to the sheet conveying device 30 according to this disclosure. However, the configuration of the sheet conveying device applicable to this disclosure is not limited thereto. It will be obvious to those skilled in the art that various changes may be made without departing from the scope and spirit of this disclosure.

Further, in the above-described configurations, the sheet conveying device that conveys a sheet or sheets is applied to this disclosure. However, the configuration applicable to this disclosure is not limited thereto. For example, this disclosure can be employed to a sheet conveying device that conveys recording media such as overhead projector (OHP) sheets and OHP films on which an image is formed or sheets such as original documents, as well as a sheet conveying device that conveys sheets including plain papers, thick papers, thin papers, coated papers, label papers and envelopes. Further, this disclosure can be applied to not only a sheet conveying device that conveys a recording medium and a sheet such as an original document but also a sheet conveying device that conveys a conveyance target medium such as a printed circuit board.

Further, the sheet conveying device 30 according to this disclosure is employed to the color image forming apparatus 1 as illustrated in FIG. 1. However, the sheet conveying device that can be applied to this disclosure may be employed to a monochrome (black and white) image forming apparatus or an image forming apparatus other than an electrophotographic image forming apparatus, for example, such as an inkjet image forming apparatus and an offset printing machine.

Figure 26:
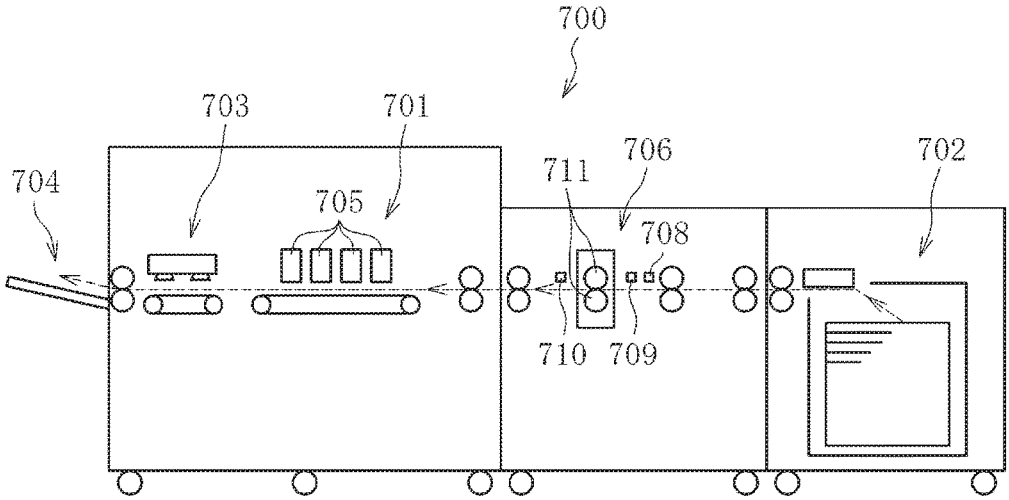
FIG. 26 is a schematic diagram illustrating an entire configuration of an image forming apparatus employing an inkjet recording method.

FIG. 26 is a schematic view illustrating a sheet conveying device employed in an inkjet image forming apparatus 700.

As illustrated in FIG. 26, the inkjet image forming apparatus 700 includes an image forming device 701, a sheet feeding device 702, a sheet conveying device 706, a drying device 703, and a sheet output device 704. The image forming device 701 includes multiple ink print heads 705 to discharge ink using an inkjet method. The sheet feeding device 702 feeds a sheet with an image formed thereon. The sheet conveying device 706 conveys the sheet. The drying device 703 dries the sheet with the image thereon. The sheet output device 704 ejects the sheet dried by the drying device 703. The sheet conveying device 706 includes multiple CISs 708, 709 and 710 and a pair of sheet holding rollers 711 in a sheet conveying passage extending from the sheet feeding device 702 to the image forming device 701. Each of the multiple CISs 708, 709 and 710 functions as a position detector to detect the position of the sheet. The pair of sheet holding rollers 711 functions as a position corrector to correct the position of the sheet based on detection results obtained by the multiple CISs 708, 709 and 710. The pair of sheet holding rollers 711, while conveying the sheet fed by the sheet feeding device 702, corrects the lateral and angular displacements of the sheet based on the detection results of the multiple CISs 708, 709 and 710. Thereafter, the sheet is conveyed to the image forming device 701. Consequently, respective color ink is discharged from the ink print heads 705 to the sheet in the image forming device 701, thereby forming an image on a surface of the sheet. After having been dried by the drying device 703, the sheet is ejected to the sheet output device 704.

In the inkjet image forming apparatus 700 as described above, it is likely that the positional deviations of the CISs 708, 709 and 710 are caused due to movement of the movable member when the CISs 708, 709 and 710 are mounted on a movable member such as a cover. In order to avoid this inconvenience, similar to the above-described embodiments, the indexes 37 are mounted on a fixed member as reference positions to calculate the positional deviation amounts of the CISs 708, 709 and 710. With this configuration, the positional deviation amounts of the CISs 708, 709 and 710 can be calculated. Accordingly, a detection error or errors of the positional deviation of a sheet due to the positional deviation of each CIS can be reduced, and therefore the sheet position correction of the sheet can be performed with high accuracy.

Further, the sheet conveying device according to this disclosure can be applied to a post processing device that performs post processing to a sheet output from an image forming apparatus.

Figure 27:
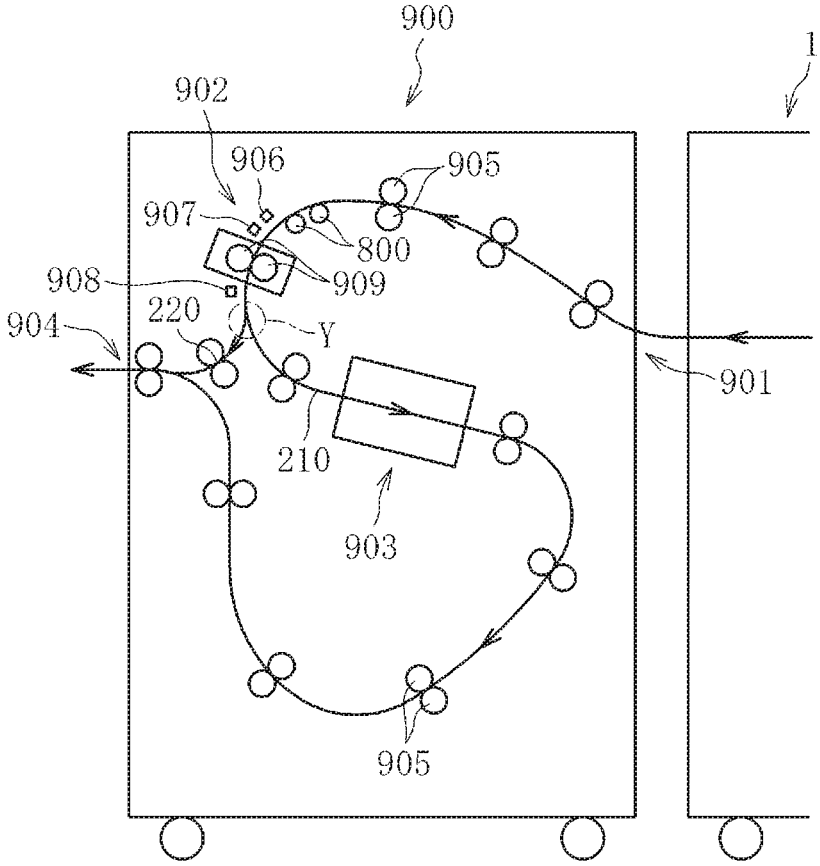
FIG. 27 is a schematic diagram illustrating an entire configuration of a post processing device.

FIG. 27 is a schematic diagram illustrating an entire configuration of a post processing device 900 including a sheet conveying device according to this disclosure.

The post processing device 900 illustrated in FIG. 27 includes a sheet receiving device 901, a sheet conveying device 902, a finishing device 903 and a sheet output device 904. The sheet receiving device 901 receives the sheet output from the image forming apparatus 1. The sheet conveying device 902 conveys the sheet received by the sheet conveying device 902. The finishing device 903 performs various finishing processes including a center folding process, a binding process and a punching process to the sheet. The sheet output device 904 ejects the sheet from the post processing device 900.

The sheet received via the sheet receiving device 901 into the post processing device 900 is conveyed by multiple pairs of sheet conveying rollers (multiple pairs of sheet conveying bodies) 905 included in the sheet conveying device 902 to either one of a first sheet conveyance passage 210 that passes through the finishing device 903 and a second sheet conveyance passage 220 that leads to the sheet output device 904 without passing through the finishing device 903. Further, the sheet conveying device 902 includes multiple CISs 906, 907 and 908 and a pair of sheet holding rollers 909. The multiple CISs 906, 907 and 908 are disposed on the upstream side of a branching portion Y at which the first sheet conveyance passage 210 and the second sheet conveyance passage 220 separate into different passage. Each of the multiple CISs 906, 907 and 908 functions as a position detector to detect the position of the sheet. The pair of sheet holding rollers 909 functions as a position corrector to correct the position of the sheet based on detection results obtained by the multiple CISs 906, 907 and 908. The pair of sheet holding rollers 909, while conveying the sheet, corrects the lateral displacement or the angular displacement of the sheet based on the detection results of the multiple CISs 906, 907 and 908. Thereafter, the sheet is conveyed to either one of the first sheet conveyance passage 210 and the second sheet conveyance passage 220.

Here, the CISs 906, 907 and 908 are held by a movable member 910 that is movably disposed to a body of the post processing device 900. During maintenance work, the movable member 910 is moved in a horizontal direction (for example, to a front side in a direction perpendicular to the drawing sheet of FIG. 27), so that the CISs 906, 907 and 908 are exposed from the body of the post processing device 900. In this configuration, it is likely that the positional deviation of the CISs 906, 907 and 908 are caused by movement of the movable member 910. In order to avoid the positional deviation, similar to the above-described image forming apparatus 1, the post processing device 900 includes the indexes 37 mounted on a fixed member such as a sheet conveyance guide, so that the indexes 37 function as respective reference positions of the CISs 906, 907 and 908 to calculate the positional deviation amounts of the CISs 906, 907 and 908. According to this configuration, the positional deviation amounts of the CISs 906, 907 and 908 are calculated, and therefore a detection error or errors of the positional deviation of a sheet due to the positional deviation of each CIS can be reduced, and therefore the sheet position calculate of the sheet can be performed with high accuracy.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a position detector configured to detect a position of a sheet;

a sheet conveying body configured to convey the sheet;

a fixed body;

a movable body on which the position detector is mounted and configured to move, relative to the fixed body, between a first position at which the position detector detects the position of the sheet and a second position different from the first position; and an index mounted on the fixed body and configured to function as a reference position based on which a positional deviation amount of the position detector at the first position is calculated.

2. The sheet conveying device according to claim 1, further comprising a detected positional deviation calculator configured to calculate a positional deviation amount of the position detector relative to the index, based on a detection result of a position of the index by the position detector.

3. The sheet conveying device according to claim 2, further comprising a reference position corrector configured to function as a reference position to detect a positional deviation amount of the sheet and correct a reference sheet conveyance position determined according to a relative positional relation to the position detector, based on the positional deviation amount of the position detector calculated by the detected positional deviation calculator.

4. The sheet conveying device according to claim 1, wherein the position detector includes multiple position detectors mounted on a single body.

5. The sheet conveying direction according to claim 1, further comprising a position corrector configured to function as the sheet conveying body and correct the position of the sheet based on the positional deviation amount of the sheet detected by the position detector.

6. The sheet conveying direction according to claim 5, wherein the position corrector is mounted on the fixed body.

7. The sheet conveying device according to claim 1, wherein the movable body includes a cover configured to cover the position detector, and wherein the cover includes an opening closably disposed opposed to the position detector.

8. An image forming apparatus comprising the sheet conveying device according to claim 1.

9. A post processing device comprising:

a sheet receiving device configured to receive a sheet conveyed from an image forming apparatus; and the sheet conveying device according to claim 1.

10. A sheet conveying device comprising:

a position detector configured to detect a position of a sheet;

a data storing device configured to function as a reference position to detect a positional deviation amount of the sheet and store a reference sheet conveyance position determined according to a relative positional relation to the position detector, a conveyance positional deviation calculator configured to calculate a positional deviation amount of the sheet relative to the reference sheet conveyance position, based on a detection result of the position of the sheet by the position detector, a sheet conveying body configured to convey the sheet;

a fixed body;

a movable body on which the position detector is mounted and configured to move, relative to the fixed body, between a first position at which the position detector detects the position of the sheet and a second position different from the first position;

an index mounted on the fixed body at a position opposed to the position detector when the movable body is located at the first position;

a detected positional deviation calculator configured to calculate a positional deviation amount of the position detector relative to the index, based on a detection result of a position of the index by the position detector; and a reference position corrector configured to correct the reference sheet conveyance position, based on the positional deviation amount of the position detector calculated by the detected positional deviation calculator.

11. The sheet conveying device according to claim 10, wherein the position detector includes multiple position detectors mounted on a single body.

12. The sheet conveying device according to claim 10, further comprising a position corrector configured to function as the sheet conveying body and correct the position of the sheet based on the positional deviation amount of the sheet detected by the position detector.

13. The sheet conveying direction according to claim 12, wherein the position corrector is mounted on the fixed body.

14. The sheet conveying direction according to claim 10, wherein the movable body includes a cover configured to cover the position detector, and wherein the cover includes an opening closably disposed opposed to the position detector.

15. An image forming apparatus comprising the sheet conveying device according to claim 10.

16. A post processing device comprising:

a sheet receiving device configured to receive a sheet conveyed from an image forming apparatus; and the sheet conveying device according to claim 10.

* * * * *